US005128724A

United States Patent [19]

Hayashi et al.

[11] Patent Number: 5,128,724

[45] Date of Patent: Jul. 7, 1992

[54] DEVELOPER RESTORING UNIT IN AN IMAGE FORMING APPARATUS

[75] Inventors: Mitsuo Hayashi, Hamura; Noriki Ono; Takao Yorifuji, both of Higashiyamato; Masatoshi Maruyama, Tachikawa, all of Japan

[73] Assignees: Casio Computer Co., Ltd.; Casio Electronics Manufacturing Co., Ltd., Tokyo, Japan

[21] Appl. No.: 452,282

[22] Filed: Dec. 18, 1989

[30] Foreign Application Priority Data

| | | | |
|---|---|---|---|
| Dec. 23, 1988 | [JP] | Japan | 63-166987[U] |
| Dec. 26, 1988 | [JP] | Japan | 63-328371 |
| Jan. 17, 1989 | [JP] | Japan | 1-2666[U] |
| Jan. 17, 1989 | [JP] | Japan | 1-2667[U] |
| Jan. 17, 1989 | [JP] | Japan | 1-2668[U] |
| Mar. 9, 1989 | [JP] | Japan | 1-26778 |

[51] Int. Cl.[5] ..... G03G 21/00

[52] U.S. Cl. ..... 355/298; 355/245

[58] Field of Search ..... 355/245, 246, 298

[56] References Cited

U.S. PATENT DOCUMENTS

| | | | |
|---|---|---|---|
| 3,752,576 | 8/1973 | Gerbasi | 355/298 X |
| 4,030,824 | 6/1977 | Smith | 355/298 |
| 4,313,674 | 2/1982 | Ura et al. | 355/298 |
| 4,323,306 | 4/1982 | Ito et al. | 355/299 |
| 4,630,653 | 12/1986 | Kan | 355/298 X |
| 4,768,055 | 8/1988 | Takamatsu et al. | 355/298 |
| 4,849,791 | 7/1989 | Hagihara et al. | 355/298 |
| 4,937,625 | 6/1990 | Kato et al. | 355/245 |
| 4,941,022 | 7/1990 | Ohmura et al. | 355/298 |

FOREIGN PATENT DOCUMENTS

| | | | |
|---|---|---|---|
| 58-189675 | 11/1983 | Japan | 355/298 |
| 60-41079 | 3/1985 | Japan | 355/298 |
| 60-118874 | 6/1985 | Japan | 355/298 |
| 61-6679 | 1/1986 | Japan | 355/298 |
| 62-32483 | 2/1987 | Japan | 355/298 |
| 63-29776 | 2/1988 | Japan . | |
| 63-71864 | 4/1988 | Japan . | |
| 63-240579 | 10/1988 | Japan | 355/298 |

*Primary Examiner*—Fred L. Braun
*Attorney, Agent, or Firm*—Nixon & Vanderhye

[57] ABSTRACT

A developer circular unit is detachably set in a copier or a copier type printer which print on images on a paper sheet with toner. The unit includes at least a developing device, a cleaner, and a developer conveying device having a pipe communicated with both the cleaner and the developing device and a toner flowing-back preventing mechanism. The action of the mechanism is automatically released by the first set of the unit in the copier or printer and/or the first use of the copier or printer after that first set.

32 Claims, 18 Drawing Sheets

DEVELOPER RESTORING UNIT IN AN IMAGE FORMING APPARATUS

BACKGROUND OF THE INVENTION

1. Field of the Invention

The present invention relates to a developer restoring unit freely detachable to the image forming apparatus such as electrophotographic copying machines and various printers, the image forming apparatus comprising an image bearing member, means for forming latent image corresponding to image information on the surface of the image bearing member, means for developing the latent image on the surface of the image bearing member by developer, means for transferring the developed image onto recording means, a cleaner for removing the developer left on the surface of the image bearing member after the developed image transferrring process, and means for conveying the developer from the cleaner to the developing means, wherein at least the developing means, cleaner and means for conveying the developer from the cleaner to the developing means are combined with one another to form the developer restoring unit.

More particularly, the present invention relates to a developer restoring unit in which the developer conveyor means is provided with a means for preventing the developer from flowing backward from the developing means to the clearner before the unit is set to the image forming apparatus.

2. Description of the Related Art

Such developer restoring unit sometimes includes photosensitive drum which serves as the image bearing member.

Image forming apparatuses, which have the above described construction but in which developer-backflow preventing is not mounted in the developer restoring unit, have been well known from U.S. Pat. No. 3,752,576 and U.S. Pat. No. 4,323,306.

The developer restoring unit is shipped from its factory and put on the market, independently of the other various components of the image froming apparatus. A predetermined amount of developer has already been contained in the developing means of the developer restoring unit at the time when the unit is to be shipped from the factory. In a case where the unit includes no developer-backflow preventing means, therefore, the developer flows backward from the developing means to the developer conveying means and even to the cleaner when the unit is roughly treated on the way of its shipment or circulation in the market.

When it flows backward like this, the developer becomes insufficient in the developing means and this causes the image forming apparatus to sound alarm, telling that the developer is insufficient, when the developer restoring unit is set in the image forming apparatus. When developer is supplied responsive to the alarm, however, the amount of developer becomes excessive in the whole of the developer restoring unit, thereby causing the unit not to be operated as requested and making it difficult to control the density of images transferred on the recording means. In a case where the developer consists of various elements, the ratio of these elements in the developer restoring unit changes to make it impossible to well transfer image on the recording means.

When the images forming apparatus is operated, even if no alarm is sounded, under such a condition that the developer in the developing means is insufficient, image cannot be well transferred on the recording means.

In a case where the developer restoring unit includes the developer-backflow preventing means, the above-mentioned drawbacks are not caused even if the unit is roughly treated on the way of its shipment or circulation in the market.

Image forming apparatuses in which the developer restoring unit includes the developer-backflow preventing means have been well known from the published and unexamined Japanese Patent Application Nos. 63-71864 and 63-29776, for example.

An adhesive seal disclosed in the former and serving as the developer-backflow preventing means, however, the manually seal peeling work is troublesome and likely to be forgotten just before the developer restoring unit is set in the image forming apparatus.

A develope-backflow preventing means disclosed in the later must be manually operated just after the developer restoring unit is set in the image forming apparatus, but its manual operation is troblesome. In addition, the mechanism for manually operating the developer-backflow preventing means is so large-sized as to need large space.

SUMMARY OF THE INVENTION

The present invention is contrived from the above described circumstances, and the main object of the present invention is to provide a developer circulator unit including a developer-backflow preventing means easier in operation, smaller in sized and also smaller in the space for operating the developer-backflow preventing means.

The present invention has a further object to make the developer restoring unit which can achieve the above described main object by far smaller in sized and easier in operation.

The present invention has a still further object to provide a developer restoring unit wherein developer conveyed from a cleaner to a developing means by a developer conveyor means can be usually supplied only by a desired amount to the developing means.

A developer restoring unit for acheiving the first object of the present invention is constructed by combining at least developing means, a cleaner and developer conveying means, which includes a communicating pipe communicating with the cleaner and the developing means and a developer conveying member arranged in the communicating pipe and conveying developer from the cleaner to the developing means, and is freely detachable as a whole to the image forming apparatus. In addition, means for preventing developer from flowing backward through the communicating pipe from the developing means to the cleaner before the developer restoring unit is set in the images forming apparatus is provided in the developer conveying means, and the developer restoring unit further includes means for making the developer-backflow preventing means inoperative when the developer restoring unit is firstly set in the image forming apparatus and/or when the unit is firstly used.

The second object of the present invention can be achieved by projecting the communicating pipe to the outside of the developer restoring unit to form a half ring between the cleaner and the developer means and functioning it as a handle when the developer restoring unit is set in and detached from the image forming apparatus.

The third object of the present invention can be achieved by the developer restoring unit constructed as described above wherein the developing means includes a developing chamber located adjacent to the image bearing member to develop the latent image on the image bearing member, a developer supply chamber located above the developing chamber and supplied with developer, and a developer supply roll interposed between the developing chamber and the developer supply chamber and covered on the outer surface thereof by a porous elastic mater which serves to supply developer from the developer supply chamber to the developing chamber when the roll is rotated, and wherein that end of the communicating pipe which is located on the side of the developing means is arranged independent of the developing chamber and developer supply chamber and located above the developer supply roll.

DETAILED DESCRIPTION OF THE PREFERRED EMBODIMENTS

Various embodiments of the present invention and various variations thereof will be described in detail with reference to the accompanying drawings.

Figure 1:
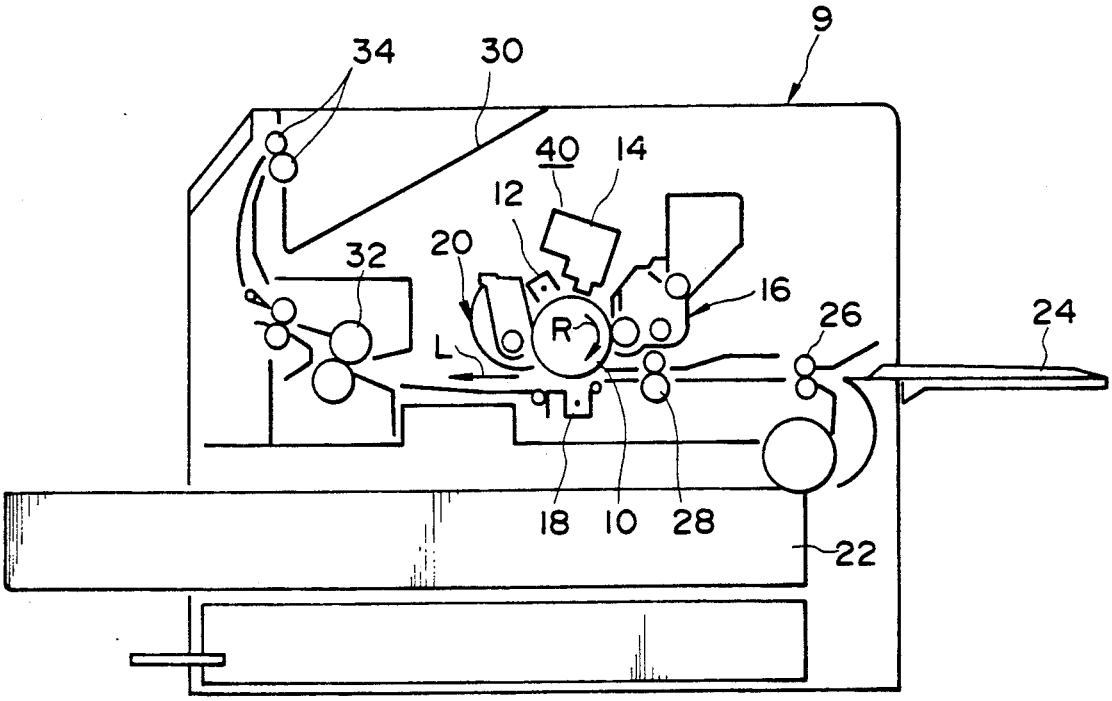
FIG. 1 is a side view schematically showing the construction of an image forming apparatus in which a developer restoring unit of a first embodiment according to the present invention is set.

FIG. 1 schematically shows an arrangement of a printer as an image forming apparatus into which a developer restoring unit according to a first embodiment of the present invention is incorporated.

Printer 9 comprises photosensitive drum 10 which serves as an image bearing member, electrifier 12, printing head 14 (a liquid crystal shutter device in this embodiment), developing device 16, transferring device 18, cleaner 20, and a paper-sheet conveying mechanism. Electrifier 12, printing head 14, developing device 16, transferring device 18, and cleaner 20 are arranged near to and around photosensitive drum 10 in this order. The paper-sheet conveying mechanism includes paired slip rolls 26 and paired waiting rolls 28, both pair of which are for conveying paper sheets as the recording means supplied from automatic paper-sheet supply cassette 22 or paper-sheet manual supply tray 24, to image transferring device 18, and paired image-fixing rolls 32 and paired sheet-discharging rolls 34, both pair of which are for conveying the image-transferred paper-sheets from image-transferring device 18 to sheet-discharging tray 30 located at the upper portion of the printer.

Electrifier 12 electrifies the photosensitive surface of photosensitive drum 10 which rotates in direction R, printing head 14 exposes the photosensitive surface of drum 10 in response to printing data, developing device 16 develops static latent images, which have been formed on the photosensitive surface of drum 10 by printing head 14, by toner, transferring device 18 transfers the toner images on the pnotosensitive surface of drum 10 to paper sheets which are supplied from manual supply tray 24 or automatic supply cassette 22 and conveyed in direction L, and cleaner 20 removes toner still left on the photosensitive surface of drum 10 after the image transferring process. Paired image-fixing rolls 32 heat the paper sheets, on which the toner images have been transferred, to fix the toner images on the paper sheets while the rolls 32 convey these paper sheets.

In this embodiment, photosensitive drum 10, cleaner 20, electrifier 12 and developing device 16 are combined with one another to form image forming unit 40, which is larger than a developer restoring unit constructed by combining cleaner 20 and developing device 16. Image forming unit 40 can be freely detachable to the printer by moving unit 40 in the horizontal direction.

Developing means 16 includes developing chamber 42 located adjacent to photosensitive drum 10 and toner supply chamber 44 located above and adjacent to developing chamber 42. In developing chamber 42, developing sleeve 46 is housed to be located adjacent to the photosensitive drum 10, and also stirring roll 48 is housed to be located below toner supply opening 47 which is formed in a partition wall between developing chamber 42 and toner supply chamber 44. In toner supply chamber 44, toner supply roll 50 is mounted to close toner supply opening 47. Toner supply roll 50 is covered on the outer surface of rotating shaft 50*a* with porous elastic matter 50*b*. Toner supply roll 50 is driven to be rotated in response to a toner supply signal generated from toner sensor 52 which is mounted in developing chamber 42. In this embodiment, developing chamber 42 is filled with developer 54 which consists of two components of toner and carrier, while toner supply chamber 44 is filled with toner 56 to be supplied.

Cleaner 20 includes cleaning blade 58 for scraping off residual toner from the surface of photosensitive drum 10, and cleaning hopper 60 for storing the scraped toner. Communicating pipe 62 of toner conveying means extends between cleaning hopper 60 and developing chamber 42 to use again toner scraped off from the surface of drum 10. In communicating pipe 62, coil member 64 which serves as the toner conveying member is coaxially arranged. End portion 62*a* of communicating pipe 62 which is located in cleaner 20 is arranged on the bottom of hopper 60 and opened into hopper 60. Communicating pipe 62 is projected outside from image forming unit 40 between hopper 60 and developing chamber 42 to form a half-ring shape. End portion 62*b* of communicating pipe 62 which is located in developing means 16 is arranged in the upper portion of developing chamber 42.

Figure 3:
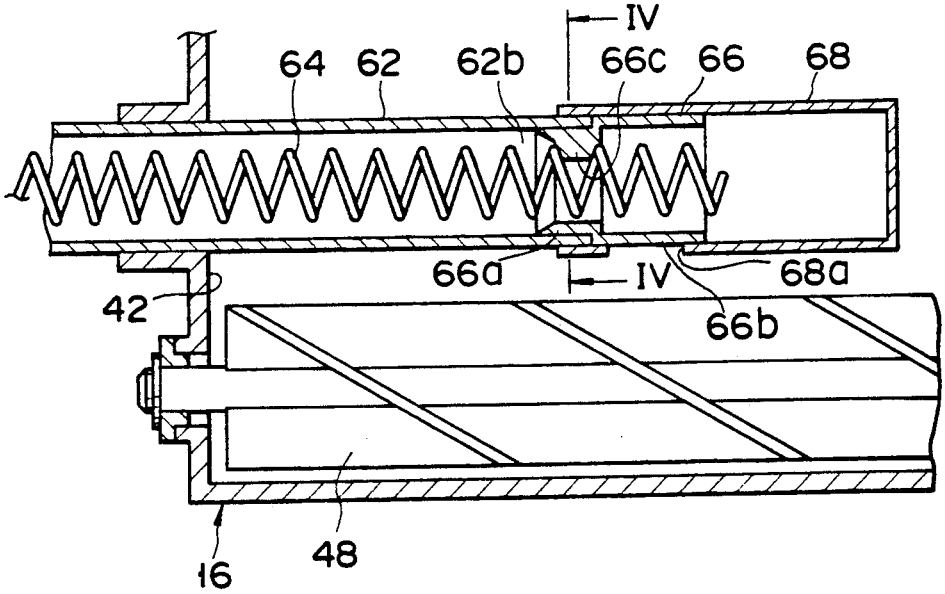
FIG 3 is an enlarged schematical longitudinal sectional view taken along line III—III in FIG. 2 and showing an end portion of developer conveyiung means of the developer restoring unit, which is located in developing means, wherein a developer discharge opening at the developing-means-side end portion on the outer peripheral surface of a communicating pipe of the developer conveying means is shield by a sheild member.

Toner conveying member 64 extends in communicating pipe 62 over the whole length of communicating pipe 62, and the cleaner-side end portion of toner conveying member 64 is selectively rotated by a rotation mechanism (not shown) when image forming unit 40 is set in the printer. As shown in FIG. 3, shutter member 66 is mounted on developing-means-side end portion 62*a* of pipe 62, and the opening end of end portion 62*b* of pipe 62 is closed by pipe end 68.

Figure 4:
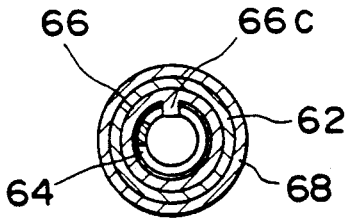
FIG. 4 is a cross sectional view taken along a line IV—IV in FIG. 3.

In this embodiment, shutter member 66 is shaped like a stepped cylinder. First cylinder portion 66*a* of shutter member 66 having smaller diameter is loosely fitted into the opening of developing-means-side end 62*b* of pipe 62 while second cylinder portion 66*b* thereof having large diameter also loosely fitted into the internal bore of pipe end 68. As shown in FIGS. 3 and 4, engaging projection 66*c* is formed in the inner surface of shutter member 66 to loosely enter into a gap between two neighboring turns of toner conveying member 64, so that shutter member 66 is rightwardly pushed out of the opening of developing-means-side end 62*b* of pipe 62 when toner conveying member 64 rotates in clockwise direction shown by an arrow in FIG. 2 to convey toner from cleaner 20 to developing means 16.

Toner discharge opening 68*a* is formed in the peripheral wall of pipe end 68, and closed by second cylinder portion 66*b* of shutter member 66 which is fitted into the opening of end portion 62*b* of communicating pipe 62.

Then, the opening action of shutter member 66 will be explained in the following.

Figure 2:
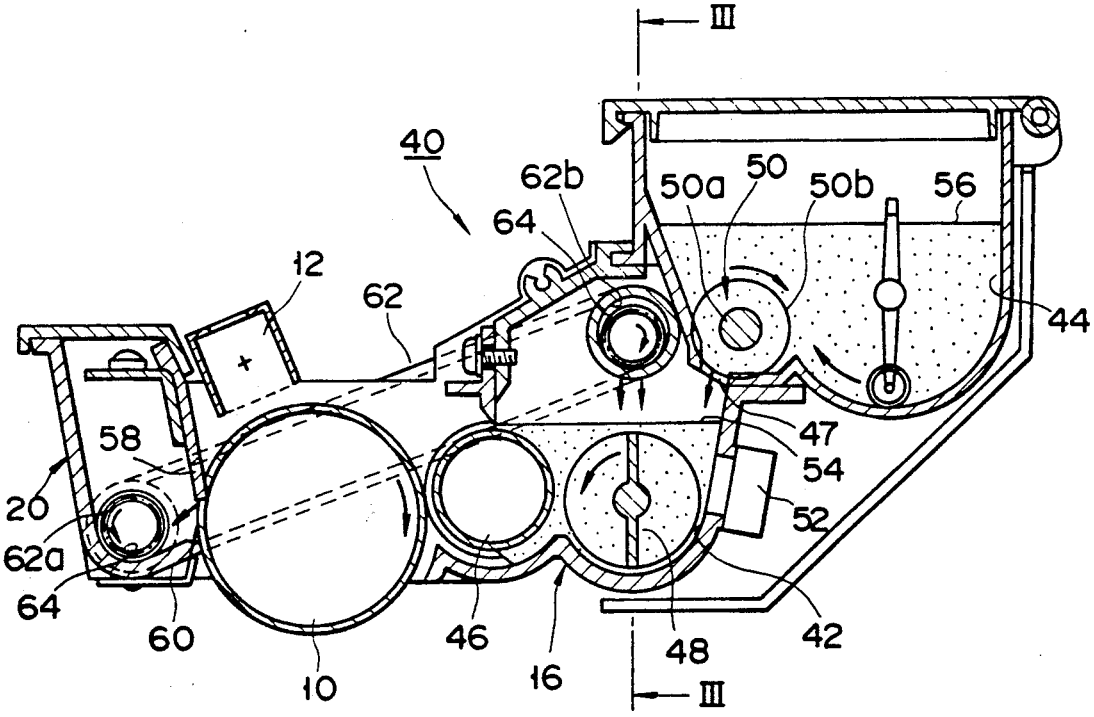
FIG. 2 is a schematical longitudinal sectional view of the developer restoring unit of the first embodiment.
Figure 5:
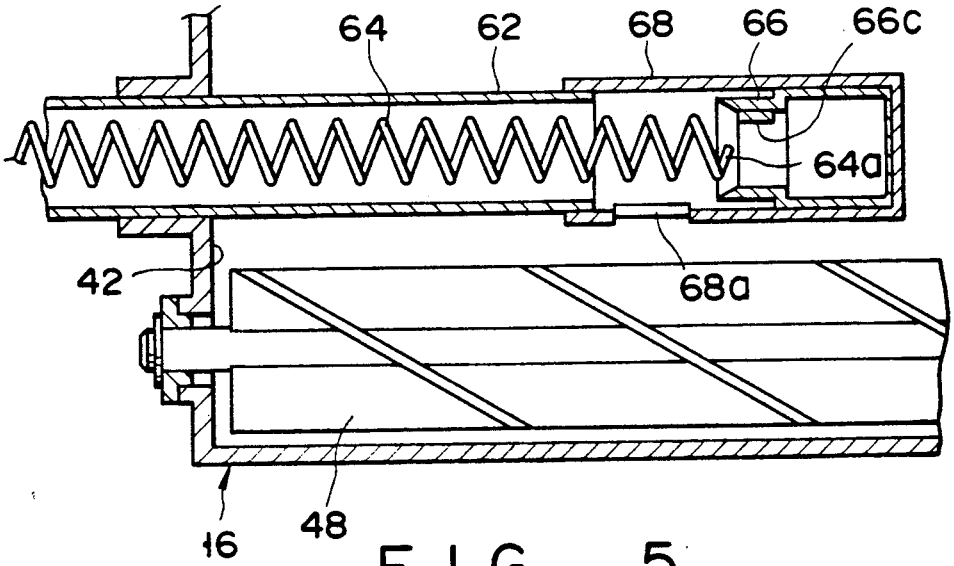
FIG. 5 is an snlarged schematical longitudinal section veiw similar to FIG. 3, but wherein the developer discharge opening of the communicating pipe is opened.

When the printer shown in FIG. 1 starts printing process after setting image forming unit 40 shown in FIG. 2 in the printer, toner conveying member 64 is rotated in communicating pipe 62 by the rotating mechanism (not shown). Shutter member 66 whose projection 66*c* is engaged with the developing-means-side end portion of toner conveying member 64 is thus moved rightwardly in FIG. 3 until projection 66*c* of shutter member 66 is released from end 64*a* of the developing-means-side end portion of toner conveying member 64, as shown in FIG. 5. When shutter member 66 is separated rightwardly from the opening of end portion 62*b* of communicating pipe 62, developer discharge opening 66*b* is opened. Residual toner conveyed from cleaner 20 to developing means 16 through pipe 62 due to the rotation of toner conveying member 64 is dropped into developing chamber 42 through toner discharge opening 68*a* of pipe end 68.

Developer 54 in developing chamber 42 of FIGS. 3 and 5 is omitted to more clarify these figures.

Figure 6:
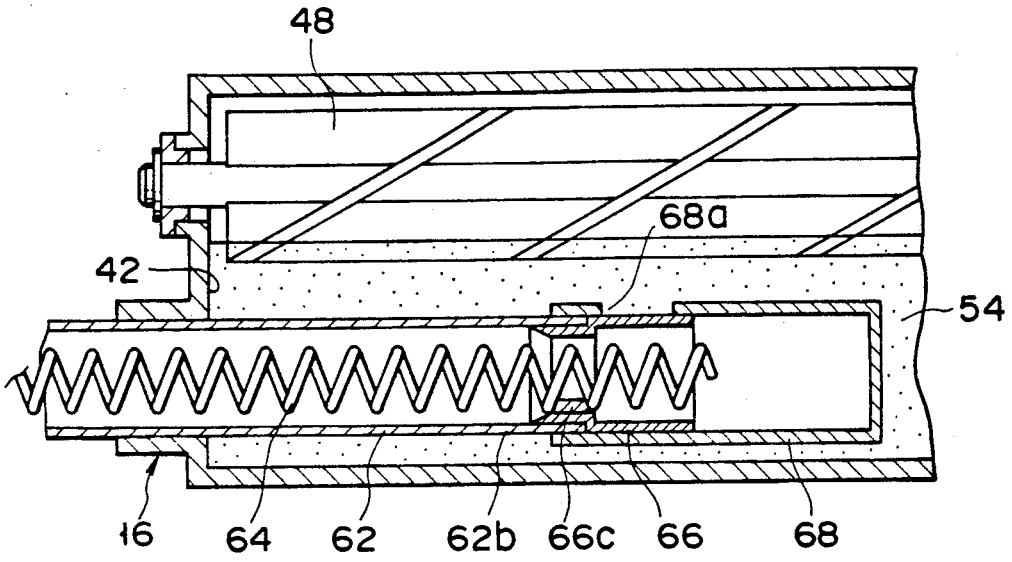
FIG. 6 is an enlarged schematical longitudinal section view similar to FIG. 3, but wherein the developer restoring unit upside while the developer discharge opening of the communicating pipe is closed by the shield member.

The opening of end portion 62*b* of communicating pipe 62 and toner discharge opening 68*a* of pipe end 68 both of which is located in developing chamber 42 are kept closed by shutter member 66 until image forming unit 40 is set in the printer and then the printer 9 starts printing process. Even when image forming unit 40 is turned upside down as shown in FIG. 6, therefore, developer 54 filled in developing chamber 42 can be prevented from entering into pipe end 68 and communicating pipe 62 through toner discharge opening 68*a* of pipe end 68 and the opening of end 62*b* of pipe 62.

This first embodiment of the present invention can be variously changed and modified. For example, pipe end 68 may be omitted. In this case, end portion 62*b* of pipe 62 is extended to a position corresponding to the closed end of pipe end 68, and the opening of end portion 62*b* of pipe 62 is closed by a cap. The toner discharge opening is formed in the peripheral wall of end portion 62*b* of pipe 62. The outer peripheral surface of shutter member 66 is shaped to have no stepped portion so as to be slidable in communicating pipe 62. Shutter member 66 may be so constructed that it is not rotated while it is moved in end portion 62b of pipe 62 by the rotation of toner conveying member 64.

Further, the shutter member 66 may be omitted. In this case, pipe end 68 is freely slidably fitted on end portion 62b of communicating pipe 62, and the projection which enters into a gap between two neighboring turns of toner conveying member 64 is formed on the inner peripheral surface of pipe end 68. In this case, the toner discharge opening is formed in the peripheral wall of one or both of communicating pipe 62 and slidable pipe end 68. In addition, a mechanism for preventing pipe end 68 from falling out of end portion 62b of pipe 62 is needed.

An image forming unit, which includes a developer restoring unit accordign to a second embodiment of the present invention, will be described in detail with reference to FIGS. 7 through 9. The same reference numerals in the second embodiment as those in the frist embodiment denote the same components as in the first embodiment, and a description thereof will be omitted.

Figure 7:
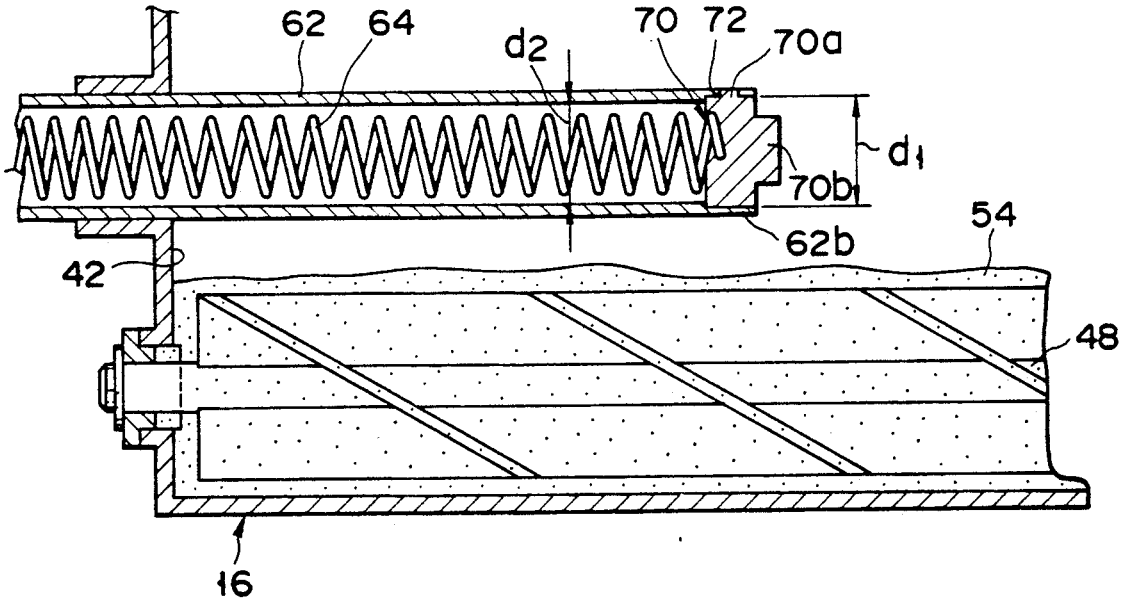
FIG. 7 is an enlarged schematical longitudinal section view of an end portion of developer conveying means of a developer restoring unit according to a second embodiment of the present invention, which is located in developing means, wherein a developer discharge opening at an open end on a developing-means-end portion of a communicating pipe of the developer conveying means is shield by a shielding member.

In the case of the second embodiment, the opening of developing-means-side end 62b of communicating pipe 62 is sealed by seal member 70 which is fitted into the opening, as shown in FIG. 7. Seal member 70 is formed to have a columnar shape, and engaging protrusion 70a is formed at a proper position on the outer peripheral surface thereof. Knob 70b is formed on the outer end surface of seal member 70. Seal member 70 formed as described above is fixed to toner conveying member 64 in such a way that the developing-means-side end of toner conveying member 64 is embedded in the inner end surface of seal member 70.

Figure 8:
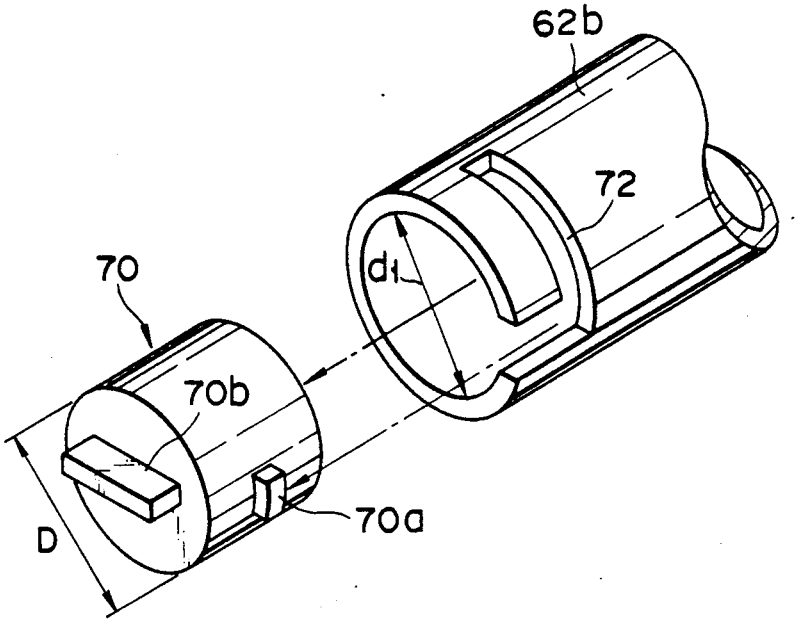
FIG. 8 is an enlarged schematical perspective view showing both of the developing-means-side end portion of the communicating pipe and the shield member in a condition that they are separated from each other.

Inner diameter dl of developing-means-side end portion 62b of communicating pipe 62 is larger than that of the other portion thereof and substantially the same as outer diameter D of seal member 70 (see FIG. 8). As shown in FIG. 8, substantially L-shaped engaging groove 72 is formed in the peripheral wall of developing-means-side end portion 62b to extend from the opening of end portion 62b of pipe 62 in the axial direction of pipe 62 and then in the circumferential direction thereof. The circumferentially extending portion of engaging groove 72 extends within about 90 degrees around the center axis of pipe 62. This portion of engaging groove 72 is not limited to have a length within 90 degrees but it is preferably in a range of about 45 to 135 degrees.

Figure 9:
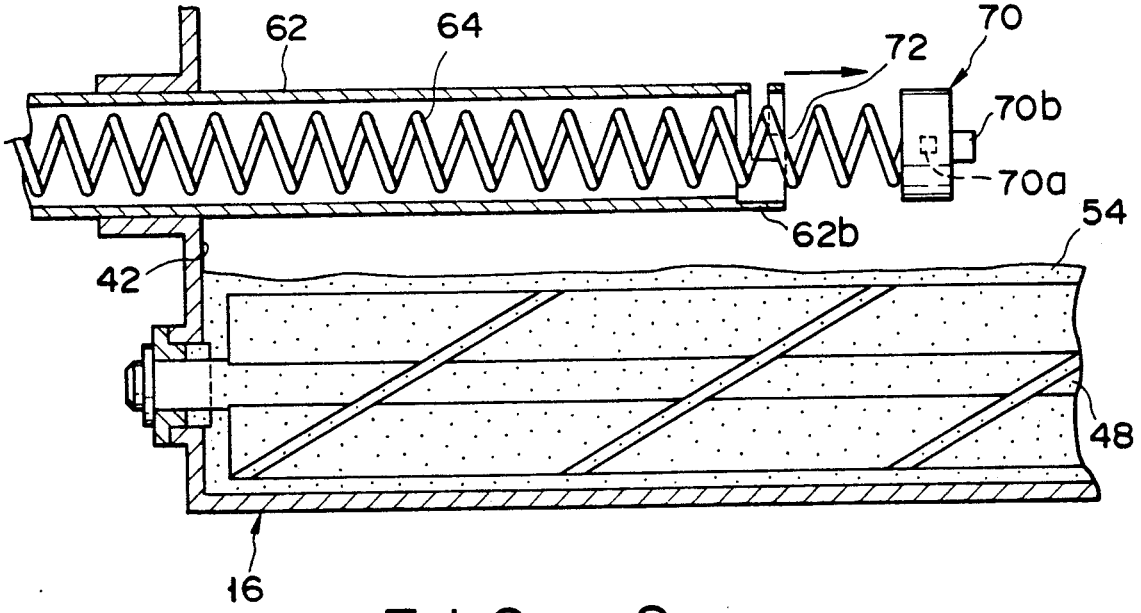
FIG. 9 is an enlarged schematical longitudinal sectional view similar to FIG. 7, wherein the shield member is separated from the developer discharge opening of the communicating pipe to open the latter.

As shown in FIG. 9, seal member 70, which has been separated from developing-means-side end 62b of connecting pipe 62, is pushed into end portion 62b of pipe 62 against the urging force of toner conveyor member 64, which has been expanded to its limit, while gripping knob 70b of seal member 70 by fingers. At this time, engaging protrusion 70a of seal member 70 is inserted in an axially extending portion of engaged groove 72 of pipe 62. When protrusion 70a strikes against the inner end of the axially extending portion of engaged groove 72 and it is stopped from entering into end portion 62b of pipe 62, seal member 70 is then rotated in anti-clockwise direction (when viewed from outside) until protrustion 70 strikes against the inner end of the circumferentially extending portion of engaged groove 72. Seal member 70 is thus held in end portion 62b of pipe 62 against the urging force of toner conveying member 64, as shown in FIG. 7.

Even when the image forming unit is turned upside down, therefore, developer 54 in developing chamber 42 can be prevented from flowing backward into communicating pipe 62.

When the image forming unit, which includes the developer restoring unit according to the present invention and constructed as described above, is set in the printer and then the printer starts printing process, the above described rotation mechanism (not shown) rotates toner conveying member 64 in pipe 62 in such a direction that toner conveying member 64 conveys toner from cleaner 20 to developing means 16 (clockwise direction when viewed from outside of end portion 62b of pipe 62). When seal member 70 is rotated together with toner conveying member 64 by about 90 degrees, the engagement of engaging protrusion 70a with the circumferentially extending portion of engaged groove 72 is released. Disengaged seal member 70 is then separated from end portion 62b of pipe 62 by the urging force of toner conveying member 64. The opening of end portion 62b of communicating pipe 62 is thus completely opened, thereby allowing scraped toner conveyed from cleaner 20 to developing means 16 through pipe 62 by toner conveying member 64 to drop into developing chamber 42 through the opening.

According to the present invention, the mechanism for engaging and disengaging seal member 70 with and from end portion 62b of communicating pipe 62 may be constructed by forming a female screw groove on the inner peripheral surface of end portion 62b of pipe 62 and a male screw thread on the outer peripheral surface of seal member 70. The seal member may be shaped like a cap which can be fitted on the outer peripheral surface of end portion 62b of pipe 62.

An image forming unit, which includes a developer restoring unit according to a third embodiment of the present invention, will described in detail with reference to FIGS. 10 through 12. The same reference numerals in the third embodiments as those in the first embodiment denote the same components as in the first embodiment, and a description thereof will be omitted.

Figure 10:
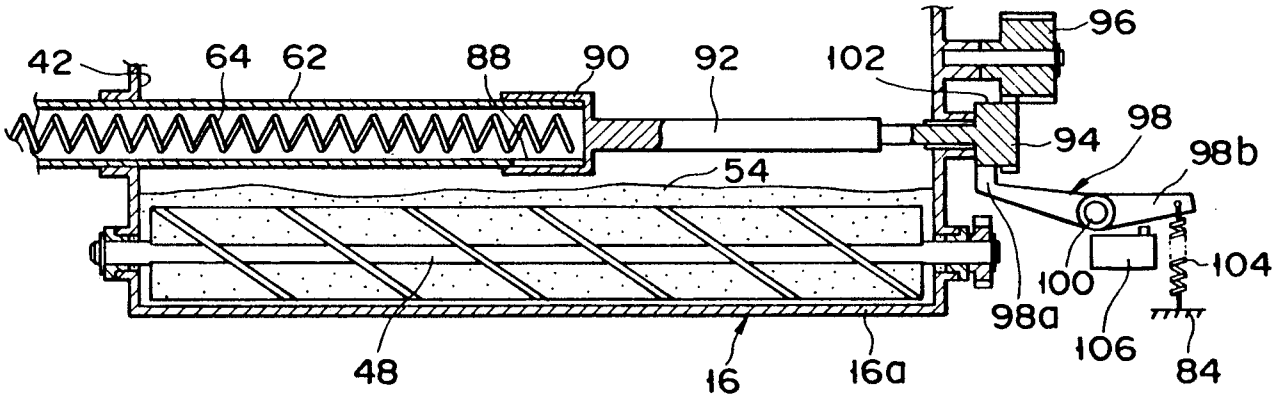
FIG. 10 is a side view schematically showing how a developer restoring unit according to a third embodiment of the present invention is set in an image forming apparatus.

FIG. 10 schematically shows an appearance of printer 82 as an image forming apparatus, in which image forming unit 80 including a developer restoring unit according to the third embodiment is freely detachably set. Printer 82 is constructed by lower body 84 and roof 86 connected to lower body 84 to be freely swingable. Image forming unit 80 can be freely mounted in and dismounted from lower body 84 of printer 82 in the vertical direction, while roof 86 is opened.

Figure 11:
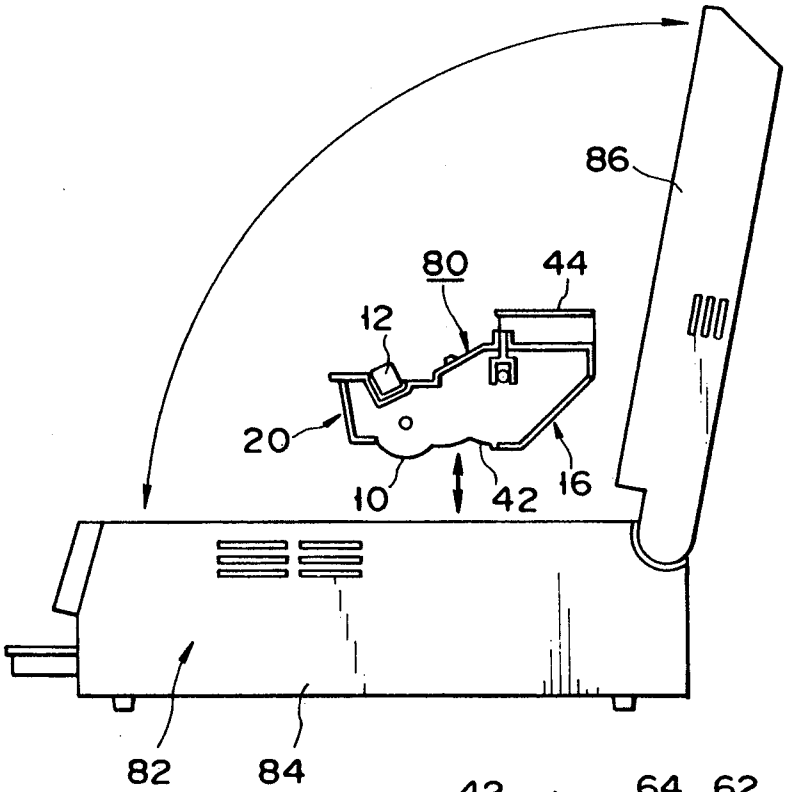
FIG. 11 is an enlarged schematical longitudinal sectional view of an end portion of developer conveying means of a developer restoring unit according to a third embodiment of the present invention, which is located in developing means, wherein a developer discharge opening at a developing-means-side end portion on the outer peripheral surface of a communication pipe of the developer conveying means is shielded by a shield member, and means for detecting the predetermined moving distance of the shield member is shown.

FIG. 11 shows developing-means-side end portion 62b of communicating pipe 62 which is located in developing means 16. A plurality of longitudinally extending ribs are arranged on the inner surface of communicating pipe 62, so that contacting areas between the inner surface of pipe 62 and toner conveying member 64 are reduced. Therefor, friction between pipe 62 and toner conveying member 64 is reduced, and contact noise caused by this friction can be prevented. End portion 62b of pipe 62 extends to a position located above the center of stirring roll 48 in developing chamber 42, and toner discharge opening 88 is formed in the lower portion of the peripheral wall of end portion 62b. Shutter member 90 whose one end is closed is slidably fitted on the outer peripheral surface of end portion 62b of pipe 62. In FIG. 11, toner discharge opening 88 at end portion 62b of pipe 62 is closed by shuttrer member 90. A shield member may be mounted on the inner surface of shutter member 90 to more tightly seal toner discharge opening 88.

Shutter driving shaft 92 is fixed to the closed end of shutter member 90 so as to be coaxial with communicating pipe 62. Shutter driving shaft 92 is screwed into casing 16*a* of developing means 16, and shutter gear 94 is fixed to the outwardly projected end of shutter driving shaft 92 which is projected outside from casing 16*a*. Shutter gear 94 engages with idler gear 96 mounted on casing 16*a*. When image forming unit 80 is set in printer 82 as shown in FIG. 10, idler gear 96 engages with a drive gear of a drive means (not shown) mounted in lower body 84 of printer 82. When image forming unit 80 is set in printer 82 and then printer 82 starts for the first printing process, therefore, shutter driving shaft 92 driven and rotated by the drive means of printer 82 through idler and shutter gears 96 and 94 is moved rightwardly in FIG. 11 to cause shutter member 90 to open toner discharge opening 88 at end portion 62*b* of pipe 62, as shown in FIG. 12. Shutter member 90 can also be moved by mounting shutter member 90 on the outer peripheral surface of end portion 62*b* of pipe 62 to be slidable only in the axial direction and screwing shutter driving shaft 92 into shutter member 90.

The third embodiment includes a means for detecting that shutter member 90 reaches at its open position. In this embodiment, the detecting means is constructed as follows. Detection lever 98 is rockably mounted in lower body 84 of printer 82 to be located adjacent to shutter gear 94 of image forming unit 80. Center of detection lever 98 is swingably pivoted on rotational center shaft 100, one end 98*a* thereof contacts the outer peripheral surface of flange 102 of shutter gear 94, flange 102 being formed adjacent to shutter gear 94, and spring 104 is stretched between the other end 98*b* thereof and lower body 84 of printer 82. Micro-switch 106 is mounted adjacent to other end 98*b* of detection lever 98. With such construction, when shutter gear 94 is rotated and moved together with shutter driving shaft 92 and shutter member 90 in the axial direction, and thus shutter member 90 reaches at its open position, sliding contact of one end 98*a* of detection lever 98 to flange 102 of shutter gear 94 is released. Detection lever 98 is thus rotated by the urging force of spring 104, and its other end 98*b* pushes micro-switch 106 to caused micro-switch 106 to generate detection signal.

Even in the case of the third embodiment, toner discharge opening 88 at end portion 62*b* of pipe 62 is closed by shutter member 90 until image forming unit 80 is set in printer 82 and then printer starts for a first printing process. This prevents developer 54 in developing chamber 42 from flowing backward into communicating pipe 62 even when image forming unit 80 is turned upside down.

The above-described detector means works at only one time for every image forming unit 80. Therefore, the detection signal generated by the detector means can be used, for example, to reset the counter of developing means 16.

End portion 62*b* of communicating pipe 62 is supported by shutter member 90 at the inner end of shutter driving shaft 92, which is supported by casing 16*a* of developing means 16. This prevent end portion 62*b* of pipe 62 from being vibrated by the rotation of toner conveyor member 64, thereby preventing pipe 62 from becoming loose at fixing portion 16*b* of casing 16*a* where pipe 62 is fixed to casing 16*a*. Further, shutter member 90 is rotated directly by the rotation means of printer 82 through idler gear 96, shutter gear 94 and shutter driving shaft 92, so that sutter member 90 can surely operate.

An image forming unit, which includes a developer restoring unit according to a fourth embodiment of the present invention, will be described in detail with reference to FIGS. 13 through 15. The same reference numerals in the fourth embodiment as those in the first embodiment denote the same components as in the first embodiment, and a description thereof will be omitted.

Figure 13:
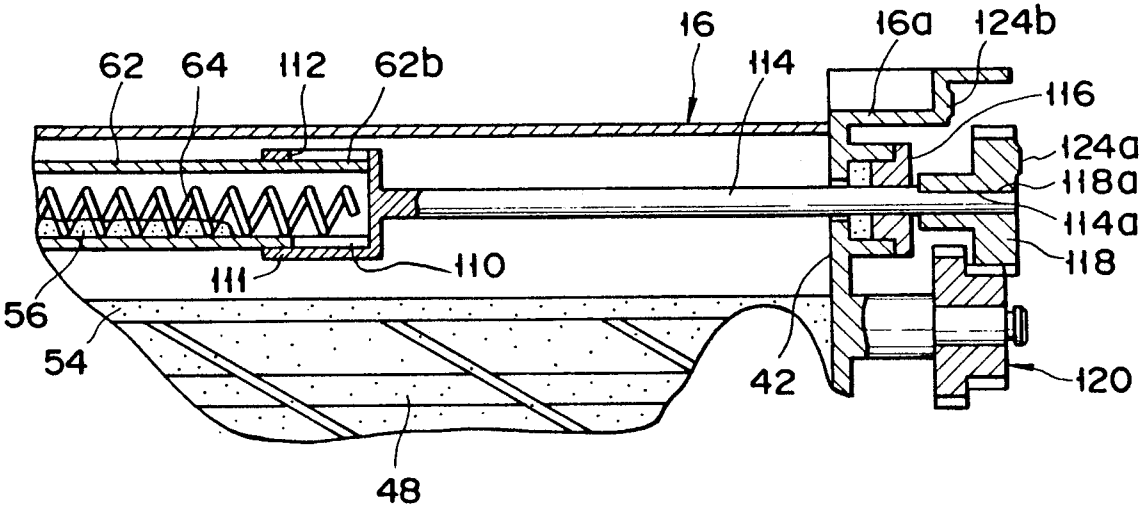
FIG. 13 is an enlarged schematical longitudinal sectional view of an end portion of developer conveying means of a developer restoring unit according to a fourth embodiment of the present invention, which is located in a developing means, wherein a developer discharge opening at a developoing-means-side end portion on the outer peripheral surface of a communicating pipe of the developer conveying means is sheild by a sheild member.

As shown in FIG. 13, end portion 62*b* of communicating pipe 62 extends to a position located above the center of stirring roll 48 in developing chamber 42 of developing means 16. Toner discharge opening 110 is formed at the lower portion of the peripheral wall of end portion 62*b* of pipe 62. A plurality of longitudinally extending ribs (not shown) are arranged on the inner surface of communicating pipe 62. These ribs can reduce contacting areas between the inner surface of pipe 62 and toner conveying member 64. Therefore, frictional resistance caused by these contact can be reduced, and contact noise caused by this frictional resistance can be prevented.

Figure 15:
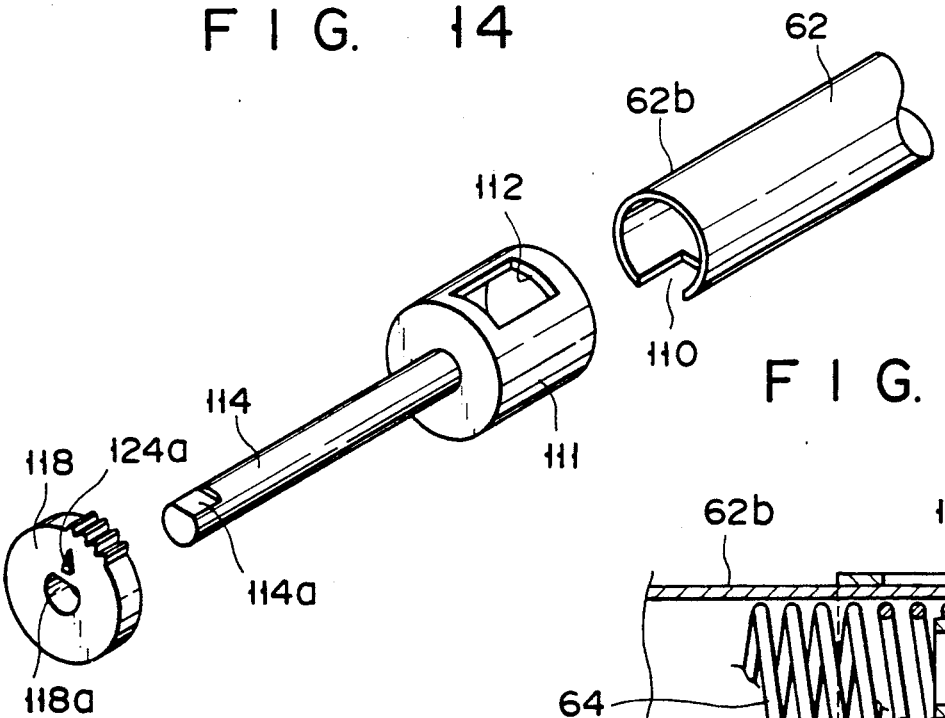
FIG. 15 is an enlarged schematical perspective view showing both the shield member and the developing-means-side end portion of the communicating pipe of FIG. 13 in a condition that they are separated from each other.

As shown in FIGS. 13 and 15, cylindrical shutter member 111 whose one end is closed is freely rotatably fitted on the outer peripheral surface of end portion 62*b* pipe 62. Toner discharge opening 112 is formed at the peripheral wall of shutter member 111. Shutter driving shaft 114 is coaxially fixed to the closed end of shutter member 111, and supported by casing 16*a* of developing means 16 through bearing 116. the circumferential surface of the outwardly projected end of shutter driving shaft 114, which is projected outside the casing 16*a*, is horizontally cut away at part 114*a* thereof, and shutter gear 118 having a center hole whose inner surface is also horizontally cut away at part 118*a* is fixed to shutter driving shaft 114, with horizontally cut part 118*a* of shutter gear 118 fitting on horizontally cut part 114*a* of driving shaft 114. End portion 62*b* of pipe 62 is supported by shutter member 111 on shutter driving shaft 114 which is supported by casing 16*a*. When toner conveying member 64 is rotated in pipe 62, therefore, end portion 62*b* of pipe 62 is not vibrated.

Figure 14:
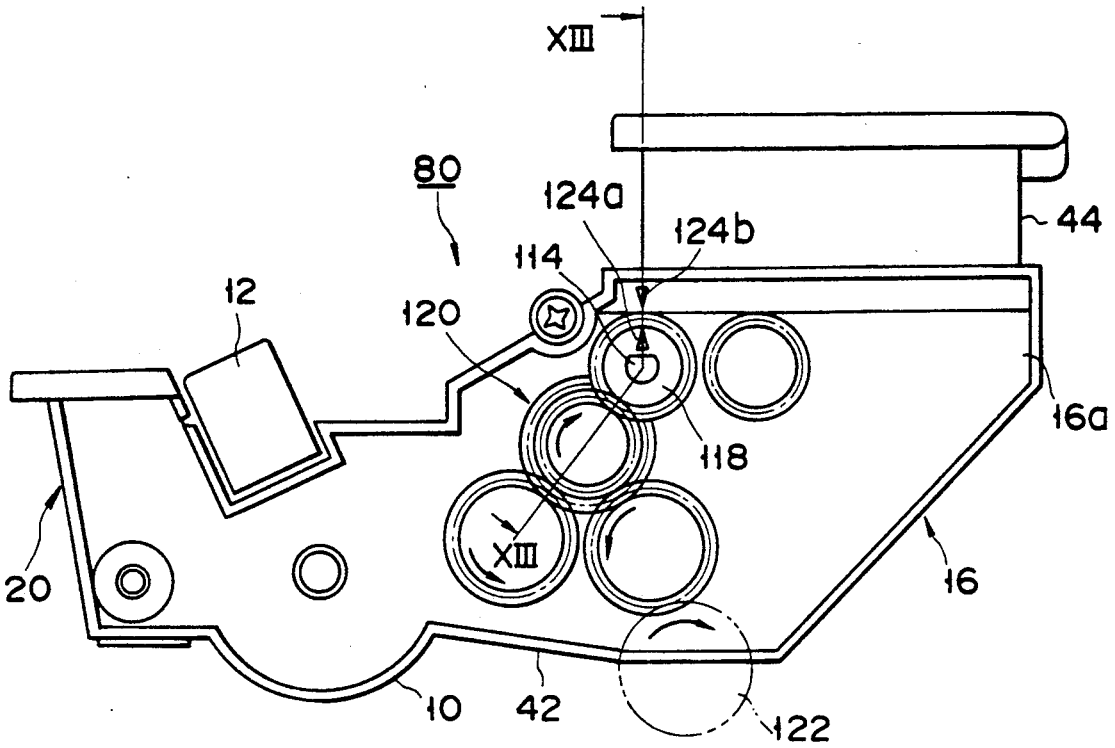
FIG. 14 is a side view schematically showing a mechanism for driving the shield member of the developer restoring unit according to the fourth embodiment shown in FIG. 13.

As shown in FIG. 14, shutter gear 118 is engaged with gear train 120 arranged on casing 16*a* of developing means 16. In the case of this mebodiment, image forming unit 80 is freely detachable to printer 82 by moving unit 80 in a vertical direction, as shown in FIG. 10. When image forming unit 80 is set in printer 82, output gear 122 driven by a rotation source (not shown) in lower body 84 of printer 82 is engaged with gear train 120.

As shown in FIGS. 13 and 14, mark 124*a* is formed on the outer side surface of shutter gear 118, and mark 124*b* is formed at a position on casing 16*a* of developing means 16, locating adjacent to shutter gear 118. When both marks 124*a* and 124*b* are on a same line, toner discharge opening 110 at end portion 62*b* of pipe 62 is closed by the circumferential wall of shutter member 111, as shown in FIG. 13. In case, developer 54 in developing chamber 42 of developing means 16 cannot flow backward into communicating pipe 62 even when image forming unit 80 is turned upside down before unit 80 is set in printer 82.

When image forming unit 80 is set in printer 82 and then printer starts printing process, shutter member 111 is rotated by rotation force transmitted from output gear 122 in FIG. 14 through gear train 120, shutter gear 118 and shutter driving shaft 114. When toner discharge opening 112 of shutter member 111 coincides with toner discharge opening 110 at end portion 62b of pipe 62 while shutter member 110 being rotated, toner 56 conveyed from cleaner 20 to developing means 16 through communicating pipe 62 is discharged into developer 54 in developing chamber 42 to be used again. Since toner discharge opening 112 of shutter member 111 is cyclically matched with toner discharge opening 110 of pipe 62 as shutter member 110 is rotated, toner discharge opening 110 of pipe 62 is intermittently opened and closed. In the case of this embodiment, the time period during which toner discharge opening 110 of pipe 62 is closed is longer than the time period during which toner discharge opening 110 is opened. However, the amount of toner 56 conveyed from cleaner 20 to developing means 16 through communicating pipe 62 occupies only several or several tens percents of toner which is used for one developing process. Therefor, toner 56 in end portion 62b of pipe 62 can be discharged into developing chamber 42 through toner discharge opening 110 of end portion 62b without clogging in end portion 62b of pipe 62.

Figure 16:
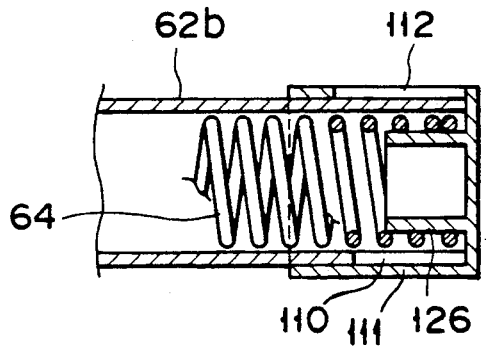
FIG. 16 is an enlarged schematical longitudinal sectional view of a developing-means-side end portion of a communicating pipe and a shield member both of which are a variation of the developer restoring unit shown in FIG. 13 and according to the fourth embodiment, wherein a developer discharge opening at the developing-means-side end portion on the outer peripheral surface of the communicating pipe is shield by the shield member.

FIG. 16 shows a variation of the above-described fourth embodiment. In this variation, shutter driving shaft 114, shutter gear 118 train 120 are omitted and shutter member 111 is rotated by toner conveying member 64 in communicating pipe 62. As shown in FIG. 16, boss 126 is coaxially formed on the inner surface of the closed end of shutter member 111, and forcibly fitted into the central bore of the terminal end of toner conveying member 64. Shutter member 110 is set at a circumferential position on end portion 62b of pipe 62 at which its toner discharge opening 112 does not overlap toner discharge opening 110 of pipe 62, thereby preventing developer 54 in developing chamber 42 from flowing backward into communicating pipe 62 until image forming unit 80 is set in printer 82. When image forming unit 80 is set in printer 82 and then printer 82 start printing process, shutter member 111 is rotated by the rotation of toner conveying member 64, so that toner discharge opening 110 at end portion 62b of pipe 62 can be intermittently opened and closed as seen in the case of the fourth embodiment.

Figure 18:
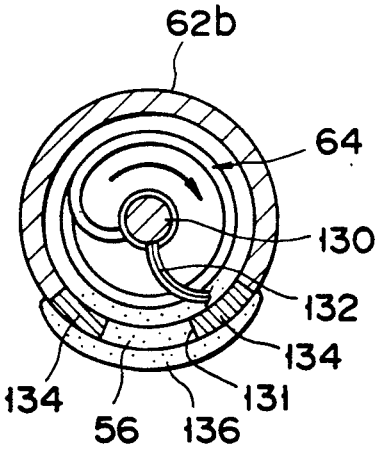
FIG. 18 is a schematical cross-sectiona view taken along a line XVIII—XVIII in FIG. 17.
Figure 19:
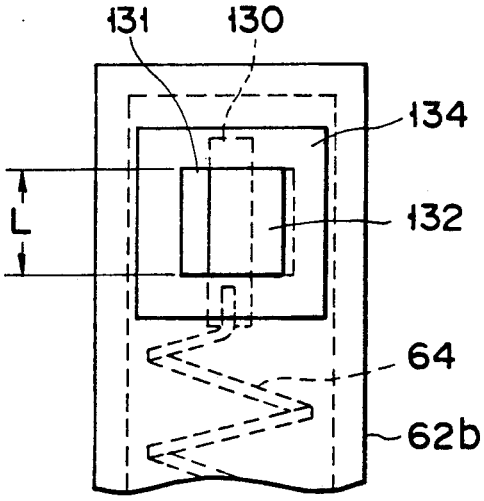
FIG. 19 is an enlarged bottom view schematically showing the developing-means-side end portion of the developer conveying means in FIG. 17.

An image forming unit, which includes a developer restoring unit according to a fifth embodiment of the present invention, will be described in detail with reference to FIGS. 17 through 19. The same reference numerals in the fifth embodiment as those in the first embodiment denote the same components as in the first embodiment, and a description thereof be omitted. The image forming unit of this embodiment is freely detachable to the printer by moving the unit in a horizontal direction to the side surface of the printer.

Figure 17:
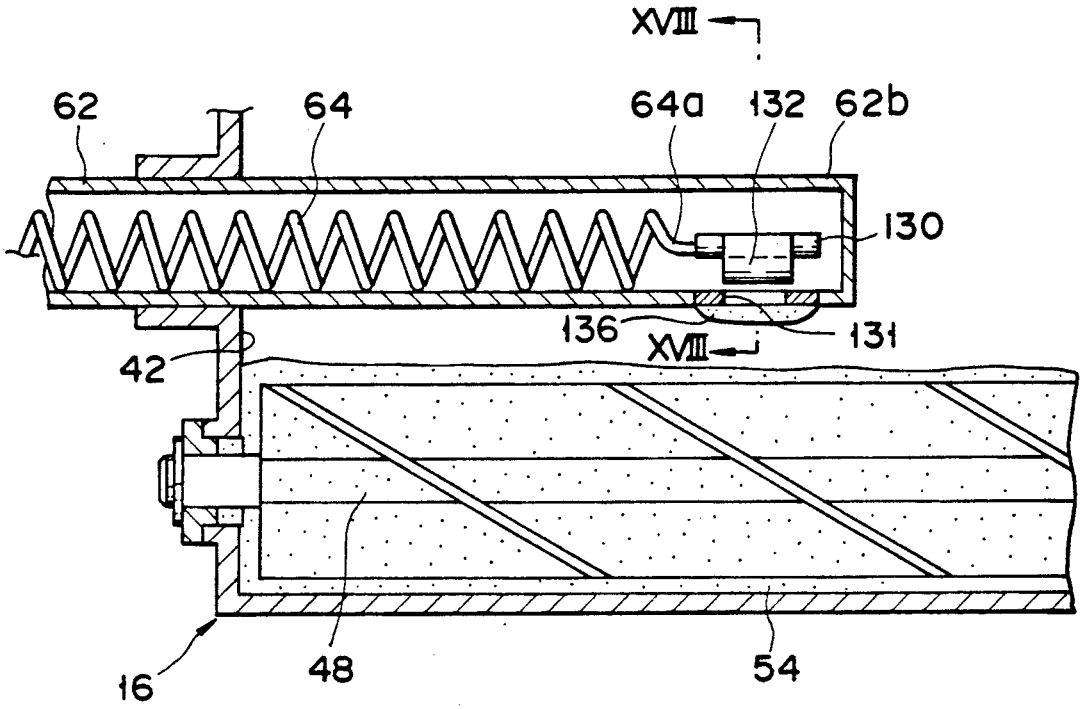
FIG. 17 is an enlarged schematical longitudinal sectional view of an end portion of developer conveying means of a developing restoring unit according to a fifth embodiment of the present invention, which is located in developing means, wherein a developer discharge opening at a seveloping-means-side end portion on an outer peripheral surface of a communicating pipe of the developer conveying means is sheilded by magnetic power in developer attracted by a magnet which is arranged around the developer discharge opening of the pipe.

As shown in FIG. 17, terminal end 64a of toner conveying member 64 extends straight forwardly in end 62b portion of communicating pipe 62, and support shaft 130 is coaxially fixed to this straight end 64a of toner conveying member 64. As shown in FIGS. 17 through 19, distal end of portion 62b of pipe 62 is closed, and toner discharge opening 131 is formed at the lower end of end portion 62b of pipe 62. One end portion of beating sheet 132 made by non-magnetic flexible sheet material such as Mylar (trade name) is wound around and fixed on support shaft 130. The size of beating sheet 132 in the axial direction is substantially the same as length L of toner discharge opening 131, and the circumferential length of sheet 132 is made longer than the radius of the inner peripheral surface of pipe 62 so as to enable the free end portion of beating sheet 132 to slide on the inner peripheral surface of pipe 62.

Magnet 134 is embedded around toner discharge opening 131 at end portion 62b of communicating pipe 62. A curtain of magnetic field is thus formed at toner discharge opening 131, and magnetic carriers belonging to one of the two components which form developer 54 in developing chamber 42 collect in toner discharge opening 131 along the curtain of magnetic field to form curtain 136 of magnetic carriers in toner discharge opening 131. This curtain 136 of magnetic carriers in toner discharge opening 131 can prevent developer 54 in developing chamber 42 from flowing backward into communicating pipe 62 through toner discharge opening 131 when the image forming unit 40 is turned upside down before it is set in the printer. When the image forming unit is set in the printer and the printer starts printing process, beating sheet 132 is rotated together with toner conveying member 64 and to cyclically beat toner discharge opening 131. Toner 56 (shown only in FIG. 18) conveyed from cleaner 20 to end portion 62b of pipe 62 is thus forcedly beaten down into developing chamber 42 through toner discharge opening 131. Since the toner is not influenced by the magnetic field, it can relatively quickly pass through curtain 136 of magnetic carriers.

According to the present invention, the means for conveying toner from cleaner 20 to developing means 16 may use pressurized air instead of coil-spring-like toner conveying member 64. Further, the means for forcing toner in end portion 62b of pipe 62 into developing chamber 42 through curtain 136 of magnetic carriers may be constructed by a plate spring located in end portion 62b of pipe 62 and an electromagnet mounted on end portion 62b to vibrate the plate spring.

An imaging forming unit, which includes a developer restoring unit according to a sixth embodiment of the present invention, will be described in detail with reference to FIGS. 20 through 22. The same reference numerals in the sixth embodiment as those in the first embodiment denote the same components as in the first embodiment, and a description thereof will be omitted.

Figure 20:
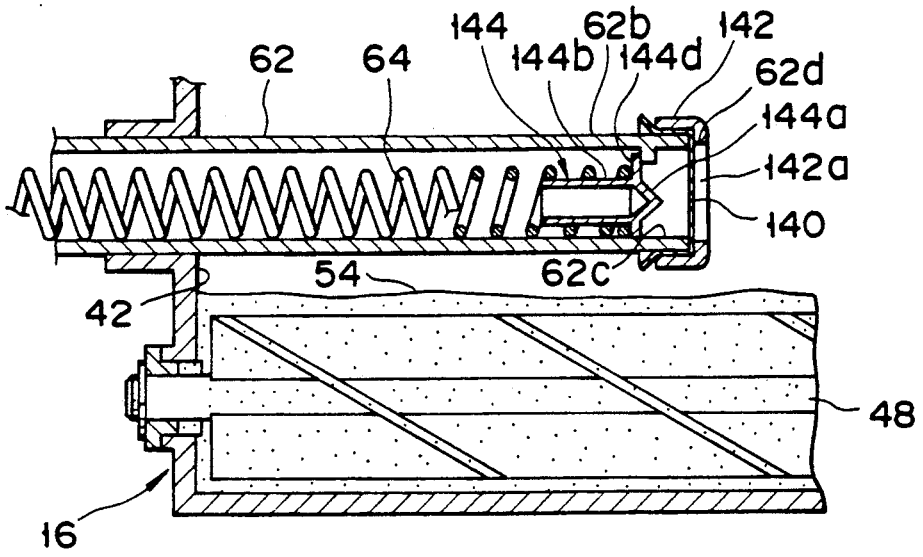
FIG. 20 is an enlarged schematical longitudinal sectional view of an end portion of developer conveying means of a developing restoring unit according to a sixth embodiment of the present invention, which is located in developing means, wherein a developer discharge opeing at an opening end of a developing-means-side end portion of a communicating pipe of the developer conveying means is shielded by a thin seal.
Figure 21:
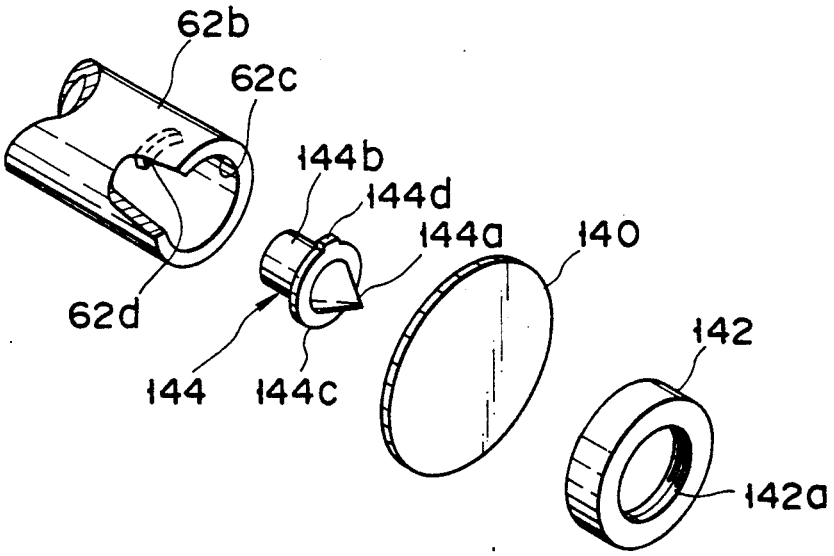
FIG. 21 is an enlarged schematical perspective view showing both the developing-means-side end portion of the communicating pipe, the thin seal, and a thin-seal breaking member in a condition that they are separated from each another.
Figure 22:
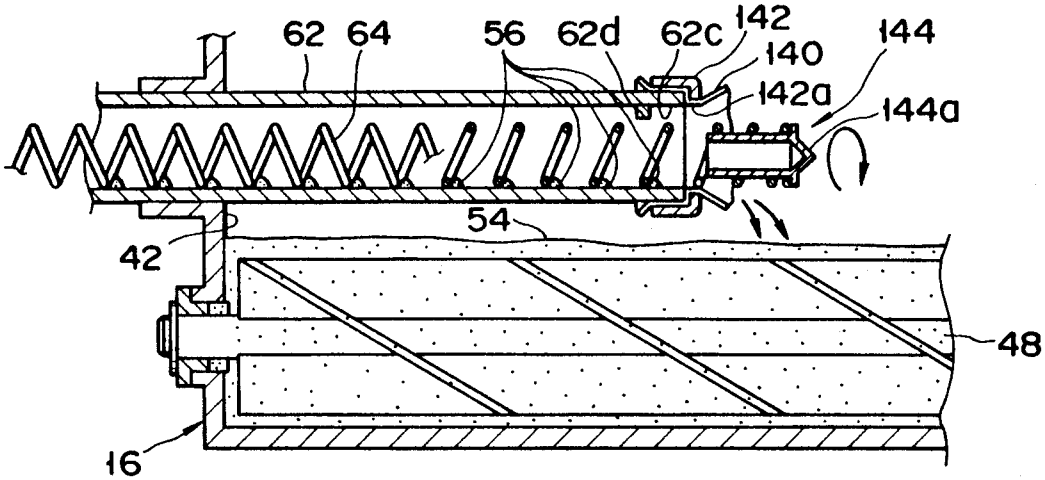
FIG. 22 is a schematical longitudinal sectional view similar to FIG. 20, wherein the thin seal for sheilding the developer discharge opening at the open end of the developing-means-side end portion of the communicating pipe is broken by the thin-seal breaking member.

As shown in FIGS. 20 and 21, open end of end portion 62b of communicating pipe 62 serves as toner discharge opening 62c, and seal sheet 140 made by thin film covers the open end of end portion 62b. Seal sheet 140 is made by a circular aluminum foil in this embodiment, and it is fixed to end portion 62b of pipe 62 by fitting cap 142, which has opening 142a in the center thereof, of the outer circumferential surface of end portion 62b of pipe 62. Namely, the rim portion of seal sheet 140 is sandwiched between the outer circumferential surface of end portion 62b of pipe 62 and fixing cap 142 fitted on the outer circumferential surface of end portion 62b of pipe 62.

Breaking member 144 is attached to the end of toner conveying member 64 in end portion 62b of pipe 62. As shown in detail particularly in FIG. 21, breaking member 144 has cylindrical body 144b whose one end is closed by conical tip portion 144a, and flange 144c is formed on the outer circumferential surface of body 144b to circumferential extend along the border of body 144b with conical tip 144a. The diameter of the outer peripheral surface of body 144b is substantially the same as the inner diameter of toner conveying member 64, and flange 144c is projected outside from the outer circumferential surface of body 144b by a distance substantially the same as the diameter of the wire rod constructing toner conveying member 64. Engaging protusion 144*d* is formed on a part of flange 144*c* to outwardly project in the radial direction. Breaking member 144 is connected to the end portion of toner conveying member 64 by forcibly fitting body 144*b* into the end portion of toner conveying member 64.

Engaged protrusion 62*d* is formed on the inner peripheral surface of end portion 62*b* of pipe 62 to project inwardly in the radial direction. Protrusion 62*d* extends in the circumferential direction of pipe 62 on the inner peropheral surface thereof. The height of engaged protrusion 62*d* from the inner peripheral surface of pipe 62 is set in such a manner that a value obtained by subtracting the height of engaged protrusion 62*d* from the inner diameter of pipe 62 becomes larger than the outer diameter of flange 144*c* of breaking member 144 but smaller than a value obtained by adding the outer diameter of flange 144*c* to the height of engaging protrusion 144*d*. Engaged protrusion 62*d* can be engaged with engaging protrusion 144*d* of breaking member 144 by pushing breaking member 144 into end portion 62*b* of pipe 62 against the urging force of toner conveyor member 64. When engaged protrusion 62*d* is engaged with engaging protrusion 144*d* of breaking member 144 in this manner, breaking member 144 is urged toward toner discharge opening 62*c* of end portion 62*b* of pipe 62 by the urging force of toner conveying member 64.

Even when the image forming unit having the above-described arrangement is turned upside down before it is set in the printer, developer 54 in developing chamber 42 cannot flow backward into communicating pipe 62 because toner discharge opening 62*c* of end portion 62*b* of pipe 62 is closed by seal sheet 140, as shown in FIG. 20.

Next, the seal-sheet breaking action of breaking member 144 will be explained in the following.

When the image forming unit arranged as described above according to the sixth embodiment of the present invention is set in the printer and the printer starts for first printing process, toner conveying member 64 is rotated in communicating pipe 62 by the rotation system (not shown) described in the first embodiment. Breaking member 144 is rotated together with toner conveying member 64, thereby releasing engaging protrusion 144*d* of breaking member 144 from engaged protrusion 62*d* in end portion 62*b* of pipe 62. Breaking member 144 is thus moved outwardly in communicating pipe 62 by the urging force of toner conveying member 64, breaks seal sheet 140 and passes through center opening 142*a* of fixing cap 142 to project outside of pipe 62. Toner discharge opening 62*c* of end portion 62*b* of pipe 62 is thus opened, so that toner 56 conveyed from cleaner 20 to developing means 16 through pipe 62 by the rotation of toner conveying member 64 can be dropped into developing chamber 42 through toner discharge opening 62*c* at end portion 62*b* of communicating pipe 62.

According to the invention, a rubber cover made of thin rubber film may be used as the seal member for sealing toner discharge opening 62*c* of end portion 62*b* of pipe 62. In this case, the rubber cover is shaped like a cap and its rim portion is formed thick like a rib, while its other portion is made so thin as to be easily breakable by breaking member 144. The outer diameter of the rib-formed rubber cover is set a little smaller than the outer diameter of the outer circumferential surface of end portion 62*b* of pipe 62. An engaged rib is formed on the outer circumferential surface of end portion 62*b* of pipe 62 to be located adjacent to toner discharge opening 62*c*.

The rubber cover can be held on end portion 62*b* with closing toner discharge opening 62*c* only by engaging the rib-formed rim portion of the rubber cover with the engaged rib on the outer circumferential surface of end portion 62*b* of pipe 62. The attaching of the rubber cover to end portion 62*b* of pipe 62 need not the independent fixing members such as fixing cap 142 used in the above-described sixth embodiment.

An imaging forming unit, which includes a developer restoring unit according to a seventh embodiment of the present invention, will be described in detail with reference to FIGS. 23 and 24.

Figure 12:
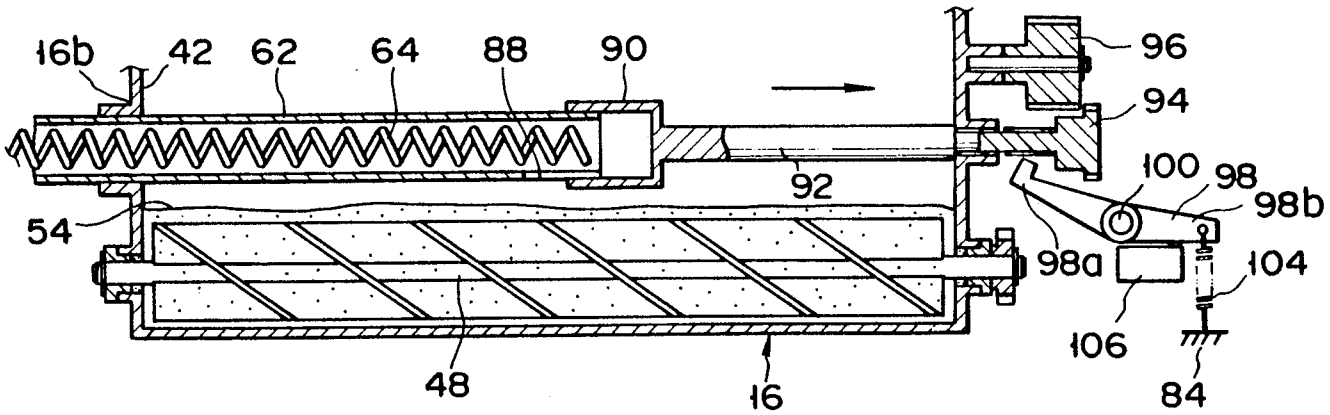
FIG. 12 is an enlarged schematical longitudinal section view similar to FIG. 10, wherein the shield member si separated by a predetermined distance from the developer discharge opening of the communicating pipe shown in FIG. 11 to open the latter.

This seventh embodiment has the same fundamental construction as the image forming unit of the third embodiment shown in FIGS. 11 and 12, and the same reference numerals in the seventh embodiment as those in the third embodiment denote the same components as in the third embodiment, and a description thereof will be omitted.

Figure 23:
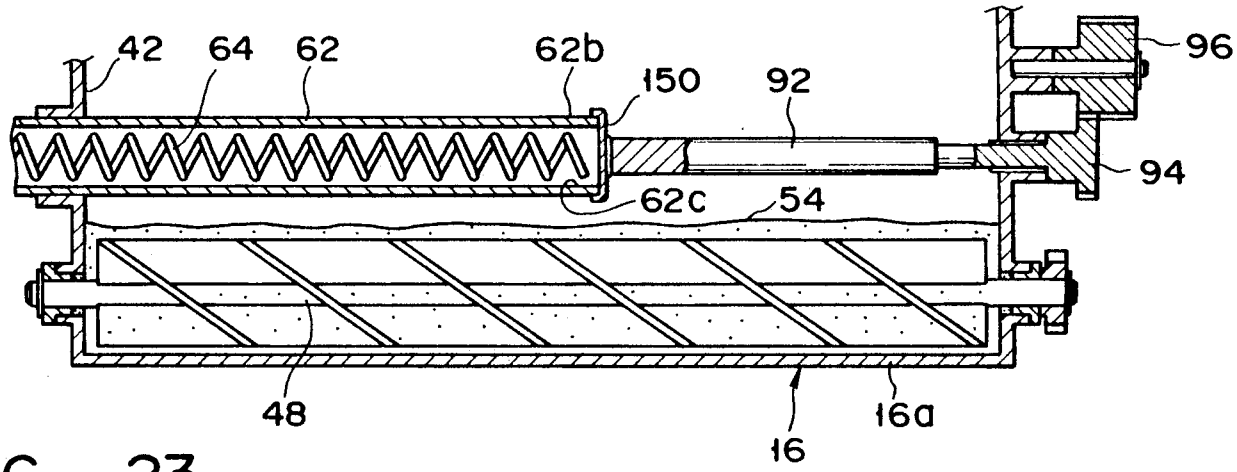
FIG. 23 is an enlarged schematical longitudinal sectional view of an end portion of developer conveying means of a developer restoring unit according to a seventh embodiment of the present invention, which is located in developing means, wherein a developer discharge opening of a developing-means-side end portion of a communicating pipe of the developer conveying means is shielded by a thin seal.

In the seventh embodiment, as shown in FIG. 23, seal sheet 150 of thin film is used instead of cylindrical shutter member 90 used in the third embodiment. In addition, a toner discharge opening of end portion 62*b* of communicating pipe 62 is constructed by opening end 62*c* of end portion 62*b*.

Seal sheet 150 closes toner discharge opening 62*c* of end portion 62*b* of pipe 62, and its rim portion is fixed to the outer circumferential surface of end portion 62*b* of pipe 62 by adhesive. The center portion of seal sheet 150 which closes toner discharge opening 62*c* is fixed by adhesive to the inner end of shutter driving shaft 92 screwed into casing 16*a* of developing means 16.

Figure 24:
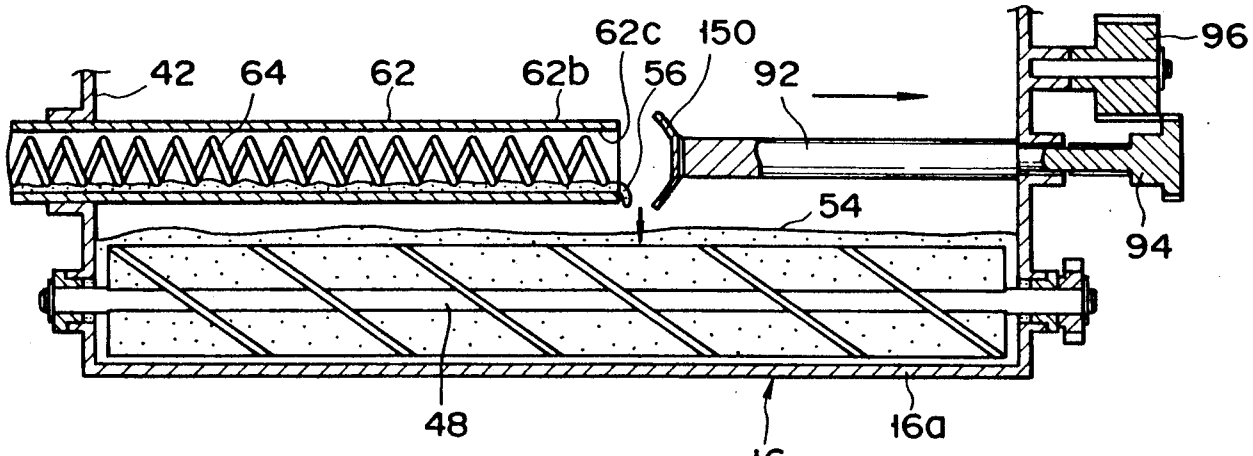
FIG. 24 is a schematical longitudinal sectional view similar to FIG. 23, wherein the thin seal film for shielding the developer discharge opening at the open end of the developing-means-side end portion of the communicating pipe is broken by the thin-seal breaking member.

When the image forming unit according to the seventh embodiment and constructed as described above is set in the printer and the printer starts first printing process, shutter driving shaft 92 is moved away from end portion 62*b* of pipe 62 in the axial direction of pipe 62 and seal sheet 150 is thus peeled off from end portion 62*b* of pipe 62, as shown in FIG. 24. Toner discharge opening 62*c* of end portion of pipe 62 is thus opened, thereby allowing toner 56 conveyed from cleaner 20 to developing means 16 through pipe 62 by rotating toner conveying member 64 to fall into developing chamber 42 through toner discharge opening 62*c*.

An image forming unit, which includes a developer restoring unit according to an eighth embodiment of the present invention, will be described in detail with reference to FIGS. 25 through 27. The same reference numerals in the eighth embodiment as those in the first embodiment denote the same components as in the first embodiment, and the description thereof will be omitted.

The image forming unit of the eighth embodiment is freely detachable to printer 82 as shown in FIG. 10 by moving the unit in the vertical direction.

Figure 25:
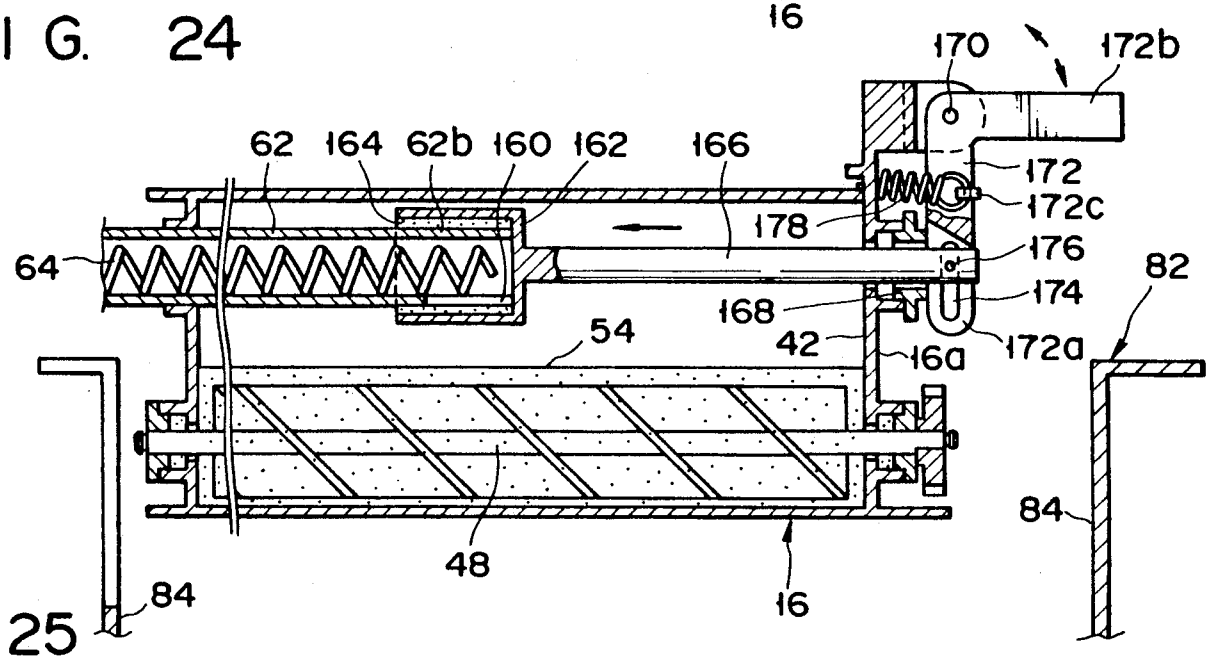
FIG. 25 is an enlarged schematical longitudinal sectional view of an end portion of developer conveying means of a developer restoring unit according to an eighth embodiment of the present invention, which is located in developing means, wherein a developer discharge opening at a developing-means-side end portion on the outer peripheral surface of a communicating pipe of the developer conveying means is shielded by a shield member.
Figure 26:
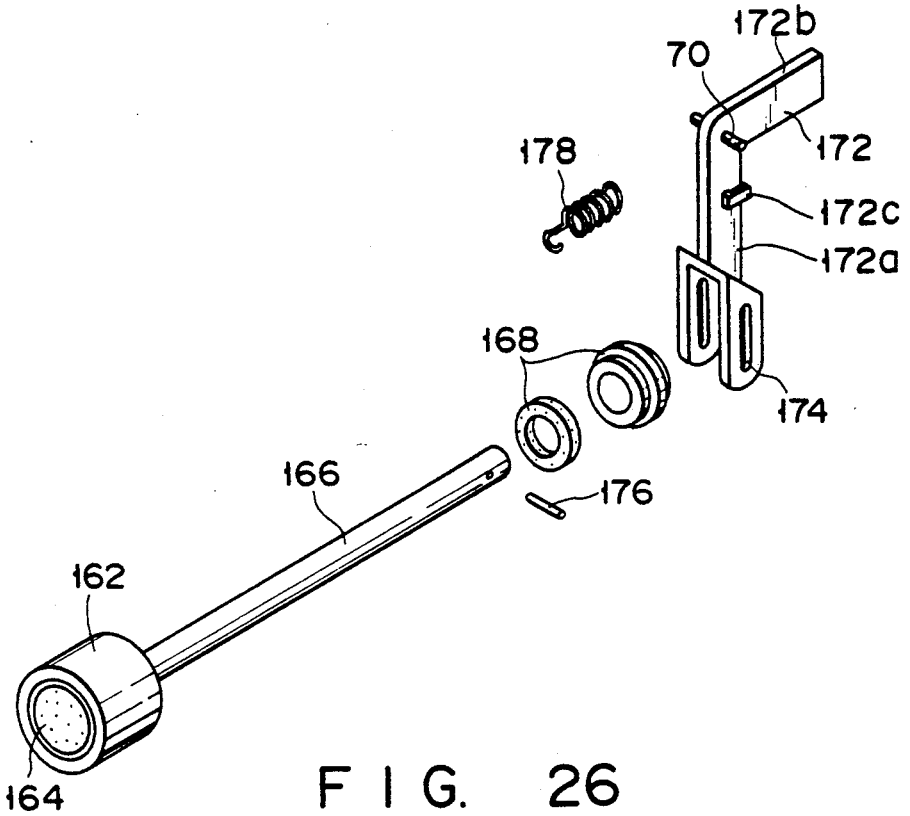
FIG. 26 is an enlarged schematical perspective view showing a mechanism for moving the shield member shown in FIG. 25, wherein the shield-member-moving mechanism is exploded.

FIG. 25 shows end portion 62*b* of communicating pipe 62 which is located in developing chamber 42 defined in casing 16*a* of developing means 16. A plurality of longitudinally extending ribs are arranged on the inner surface of pipe 62, so that contacting areas between the inner surface of pipe 62 and toner conveying member 64 are reduced. Therefore, frictional resistance generated at the contacting area can be reduced, thereby preventing contact noise from being caused by the frictional resistance.

End portion 62b of pipe 62 extends to a position located above the center of stirring roll 48 in developing chamber 42, and toner discharge opening 160 is formed, at the lower portion of the peripheral wall of end portion 62b of pipe 62. Cylindrical shutter member 162 is fitted on the outer peripheral surface of end portion 62b of pipe 62 so as to close and open toner discharge opening 160. Shutter member 162 is closed at its one end and seal member 164 is mounted on the inner surface of shutter member 162 to more tightly seal toner discharge opening 160. One end of shutter driving shaft 166 is fixed to the closed end of shutter member 162, while the other end thereof is axially slidably supported by support member 168 such as a thrust bearing on casing 16a of developing means 16. Communicating pipe 62 whose end portion 62b is supported by shutter member 162 on the one end of shutter driving shaft 166 held by casing 16a is not vibrated even when toner conveying member 64 is rotated in pipe 62.

The outwardly projected end portion of shutter driving shaft 166 which is projected outside casing 16a of developing means 16 is fixed to pin 176. Pin 76 is inserted into vertically-extending slit 174 in downwardly extending portion 172a of reversed L-shape shutter driving lever 172, the lever being pivoted on shaft 170 supported on the outside surface of the casing 16a of developing means 16, as shown in FIG. 25. Sidewardly extending portion 172b of lever 172 extends away from the outer side surface of casing 16a, and lever 172 is urged by tension coil spring 178 stretched between hook 172c on downwardly extending portion 172a and the outside surface of casing 16a to bring its downwardly extending portion 172a nearer to casing 16a or in a direction in which shutter driving shaft 166 is moved into developing chamber 42.

Shutter driving shaft 166 provided with shutter member 162, shutter driving lever 172, pin 176, tension coil spring 178 and support member 168 construct a mechanism for moving shutter member 162 to open and close toner discharge opening 160 of end portion 62b of pipe 62. FIG. 26 shows these components for the shutter member driving mechanism in a large size. In the above described condition, shutter member 162 closes toner discharge opening 160 of end portion 62b of pipe 62, as shown in FIG. 25. Therefore, developer 54 in developing chamber 42 cannot flow backward into communicating pipe 62 even when the image forming unit is turned upside down before it is set in the printer.

Figure 27:
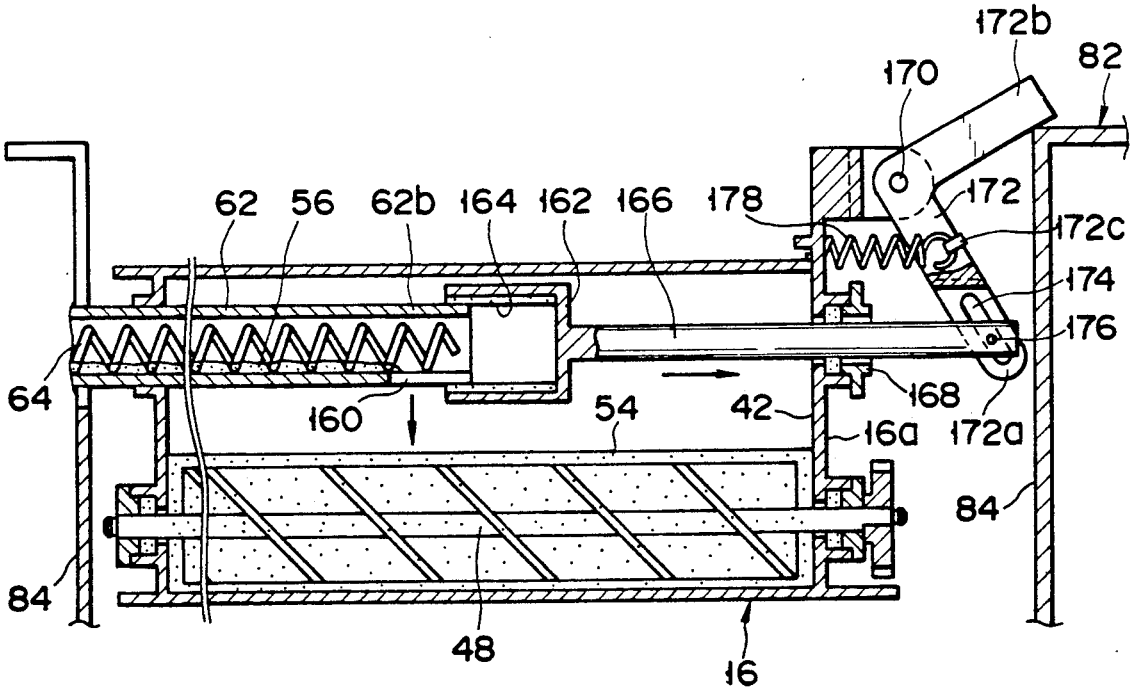
FIG. 27 is an enlarged schematical longitudinal sectional view similar to FIG.25, but wherein the developer restoring unit shown in FIG. 25 is set in an image forming apparatus so that the shield-member-moving mechanism operates to move the shield member to open the developer discharge opening of the communicating pipe.

When the image forming unit according to the eighth embodiment and constructed as described above is set in lower body 84 of printer 82 (FIG. 10), the lower edge of sidewardly extending portion 172a of lever 172 is engaged with a part of lower body 84, and lever 172 is thus swung round shaft 170 against the urging force of tension coil spring 178, as shown in FIG. 27. When lever 172 is swung as described above, shutter driving shaft 166 pin 176 of which is inserted in vertical slit 174 of downwardly extending portion 172a of lever 172 is moved away from end portion 62b of communicating pipe 62. The horizontal movement of shutter driving shaft 166 causes shutter member 162 to open toner discharge opening 160 of end portion 62b of pipe 62. Toner 56 conveyed from cleaner 20 to developing means 16 through pipe 62 by rotating toner conveying member 64 is thus dropped into developing chamber 42 through toner discharge opening 160 and mixed with developer 54 in developing chamber 42 so as to be used again.

When the image forming unit is detached from lower body 84 of printer 82, shutter driving shaft 166 is moved into developing chamber 42 by the urging force of tension coil spring 178, thereby causing shutter member 162 to close toner discharge opening 160 of end portion 62b of pipe 62.

Figure 28:
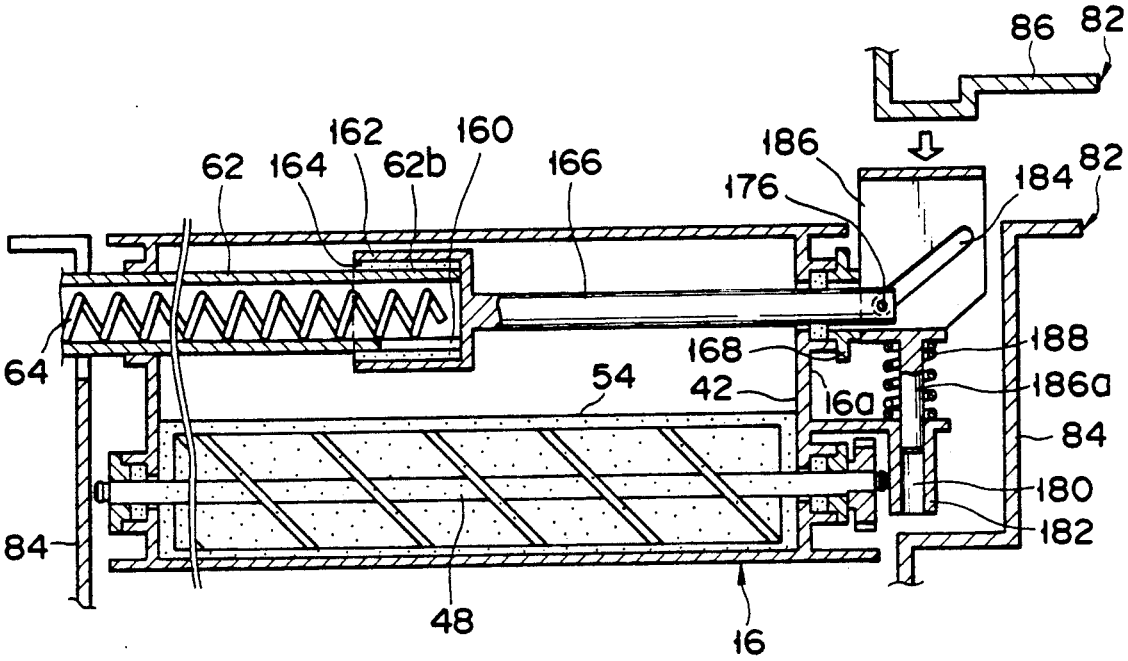
FIG. 28 is an enlarged schematical longitudinal sectional view of an end portion of developer conveying means of a developer restoring unit according to a ninth embodiment of the present invention, which is located in developing means, wherein a developer discharge opening at a developing-means-side end portion on the outer peripheral surface of a communicating pipe of the develper conveying means is shielded by a shield member.
Figure 29:
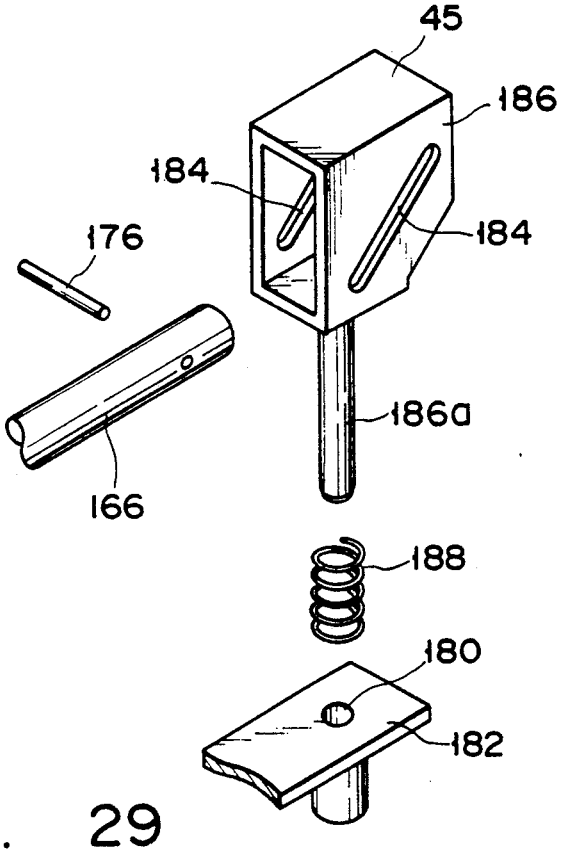
FIG. 29 is an enlarged schematical perspective view showing a mechanism for moving the shield member shown in FIG. 28, wherein the shield-member-moving mechanism is exploded.

An image forming unit, which includes a developer restoring unit according to a ninth embodiment of the present invention, will be described in detail with reference to FIGS. 28 through 30. This image forming unit of this embodiment is freely detachable to lower body 84 of printer 82 by moving the unit in the vertical direction as seen in the eight embodiment.

In this embodiment, shutter member 162, shutter driving shaft 166, and support member 168 for shutter driving shaft 166 are so arranged as the same as those in the eighth embodiment. Shutter member 162 is moved on end portion 62b of pipe 62 to close and open toner discharge opening 160 by the action of roof 86 of printer 82 toward its closing position.

Next, a shutter member opening/closing mechanism for causing shutter member 162 to move betwen open and closure positions by the opening/closing action of roof 86 will be explained, with reference to FIGS. 28 and 29. Guide member 182 having vertically-extending guide hole 180 is attached to the outer side surface of casing 16a of developing means 16 at a position below the outwardly projected end of shutter driving shaft 166. Vertically movable opening/closing member 186 in which cam groove 184 extending obliquely is located above guide member 182, and pin 176 fixed on the outwardly projected end of shutter driving shaft 166 is inserted into oblique cam groove 184 of member 186. Guide pin 186a which is inserted into guide hole 180 of guide member 182 is fixed to the undersurface of member 186, and compression coil spring 188 is wound around guide pin 186a between vertically movable member 186 and guide member 182. Spring 188 urges vertically movable member 186 upward so that pin 176 of shutter driving shaft 166 is positioned at the lower end of cam groove 184. In this condition, shutter driving shaft 166 is moved toward end portion 62b of pipe 62 in developing chamber 42, and thus shutter member 162 on one end of shutter driving shaft 166 closes toner discharge opening 160 of end portion 62b of pipe 62.

Figure 30:
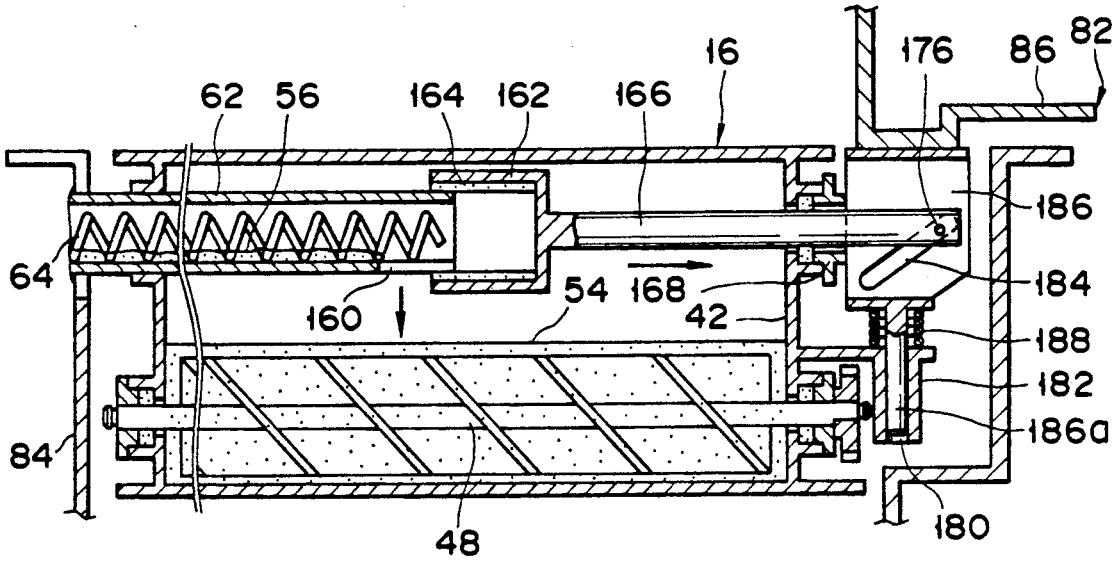
FIG. 30 is an enlarged schematical longitudinal sectional view similar to FIG. 28, but wherein the developer restoring unit shown in FIG. 28 is set in the image forming apparatus so that the shield-member-moving mechanism operates to move the shield member to open the developer discharge opening of the communicating pipe.

When the image forming unit according to the ninth embodiment is set in lower body 84 (FIG. 10) of printer 82 and then roof 86 is swung onto the top of lower body 84, a part of roof 86 strikes against the upper surface of member 186 to move member 186 downward against the urging force of compression coil spring 188, as shown in FIG. 30. Pin 176 on the shutter driving shaft 166 is thus moved along cam groove 184, causing shutter driving shaft 166 and shutter member 162 to move apart from end portion 62b of pipe 62 in the axial direction of shaft 166. As the result, toner discharge opening 160 at end portion 62b of pipe 62 is opened, and toner 56 conveyed from cleaner 20 to developing means 16 through communicating pipe 62 by rotating toner conveying member 64 is discharged to developing chamber 42 through toner discharge opening 160 and mixed with developer 54 in developing chamber 42 so as to be used again.

A variation of the eighth embodiment shown in FIGS. 25 through 27 will be described with reference to FIGS. 31 and 32. The same reference numerals in this variation as those in the eighth embodiment denote the same components as in the eighth embodiment, and the description thereof will be omitted.

Figure 31:
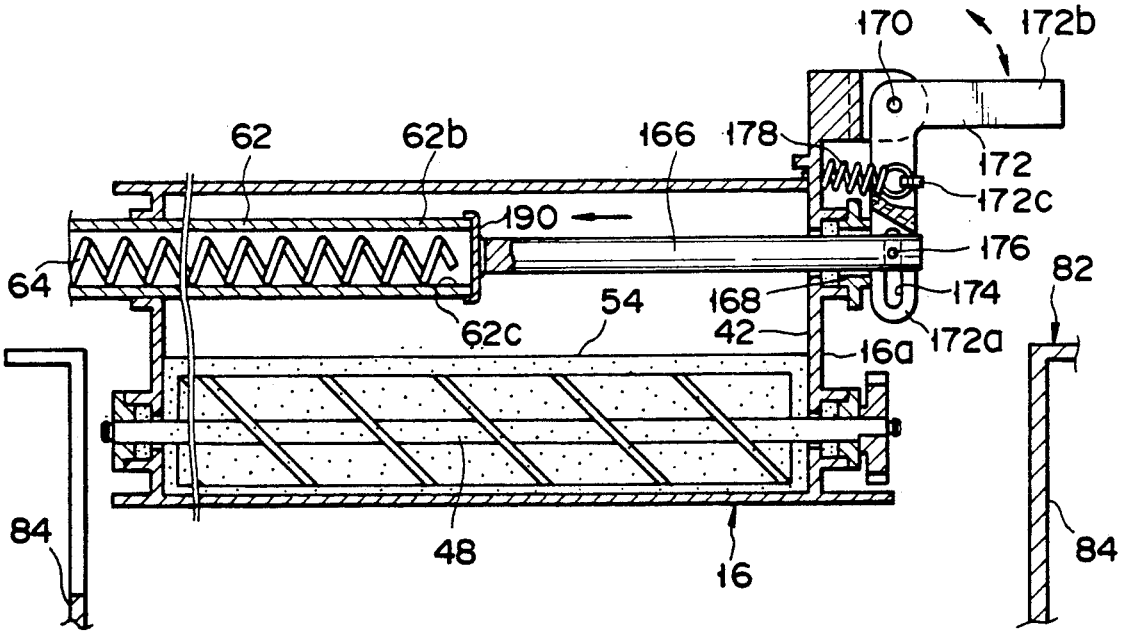
FIG. 31 is an enlarged schematical longitudinal sectional view of an end portion of developer conveying means of a variation of the developer restoring unit according to the eighth embodiment shown in FIG. 25, which is located in developing means, wherein a developing-means-side end portion of a communicating pipe of the developer conveyor means is shielded by a thin seal.

In this variation, as shown in FIG. 31, seal sheet 190 of thin film is used instead of cylindrical shutter member 162 used in the eighth embodiment. In addition, end opening 62*c* at end portion 62*b* of pipe 62 is used as the toner discharge opening.

Seal sheet 190 covers toner discharge opening 62*c* of end portion 62*b* of communicating pipe 62, and its rim portion is fixed to the outer circumferential surface of end portion 62*b* of pipe 62 by adhesive. The center portion of seal sheet 190 is fixed to the inner end of shutter driving shaft 166 by adhesive, and shutter driving shaft 166 is freely slidably supported by casing 16*a* of developing means 16.

Figure 32:
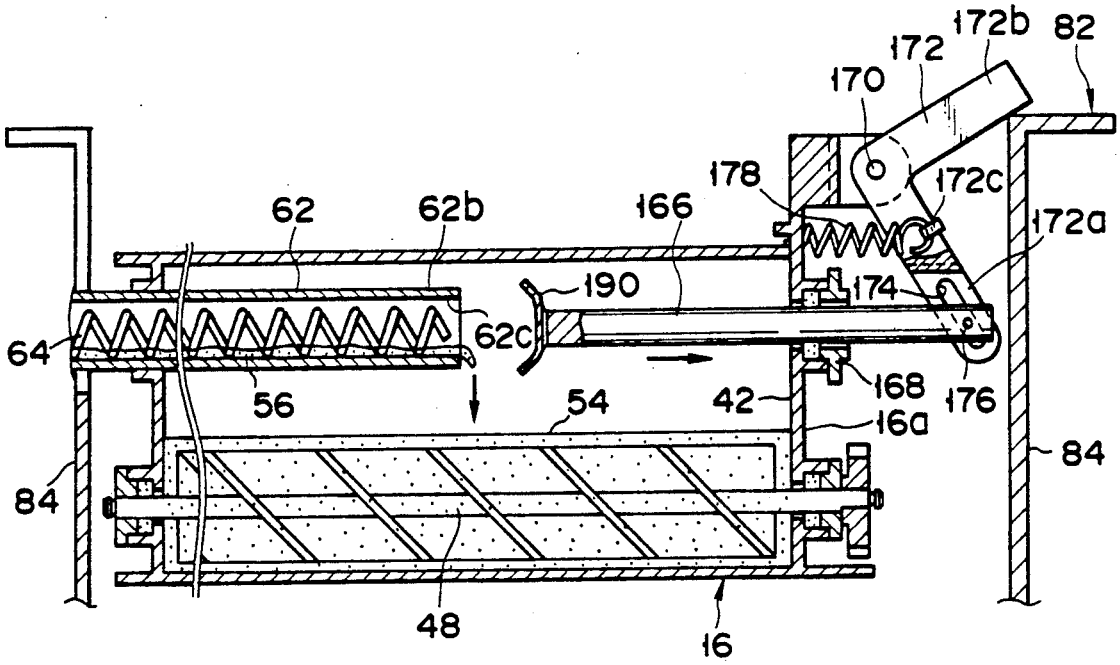
FIG. 32 is an enlarged schematical longitudinal sectional view similar to FIG. 31, but wherein the developer restoring unit shown in FIG. 31 is set in an image forming apparatus, so that a thin-seal-breaking member breaks the thin seal for a developer discharge opening of the communicating pipe.

When the image forming unit according to the variation and constructed as described above is set in lower body 84 of printer 82 (FIG. 10), shutter driving lever 172 is struck against a part of lower body 84 of printer 82 as shown in FIG. 32 and swung around pin 170 against the urging force of tension coil spring 178, thereby causing shutter driving shaft 166 to move away from end portion 62*b* of pipe 62 in the axial direction of shaft 166. Seal sheet 190 is thus peeled off from end portion 62*b* of pipe 62 to open toner discharge opening 62*c*. Toner 56 conveyed from cleaner 20 (FIG. 10) to developing means 16 (FIG. 10) through pipe 62 by rotating toner conveying member 64 is discharged into developing chamber 42 through toner discharge opening 62*c*.

A variation of the ninth embodiment shown in FIGS. 28 through 30 will be described with reference to FIGS. 33 and 34. The same reference numerals in this variation as those in the ninth embodiment denote the same components as in the ninth embodiment, and the description thereof will be omitted.

Figure 33:
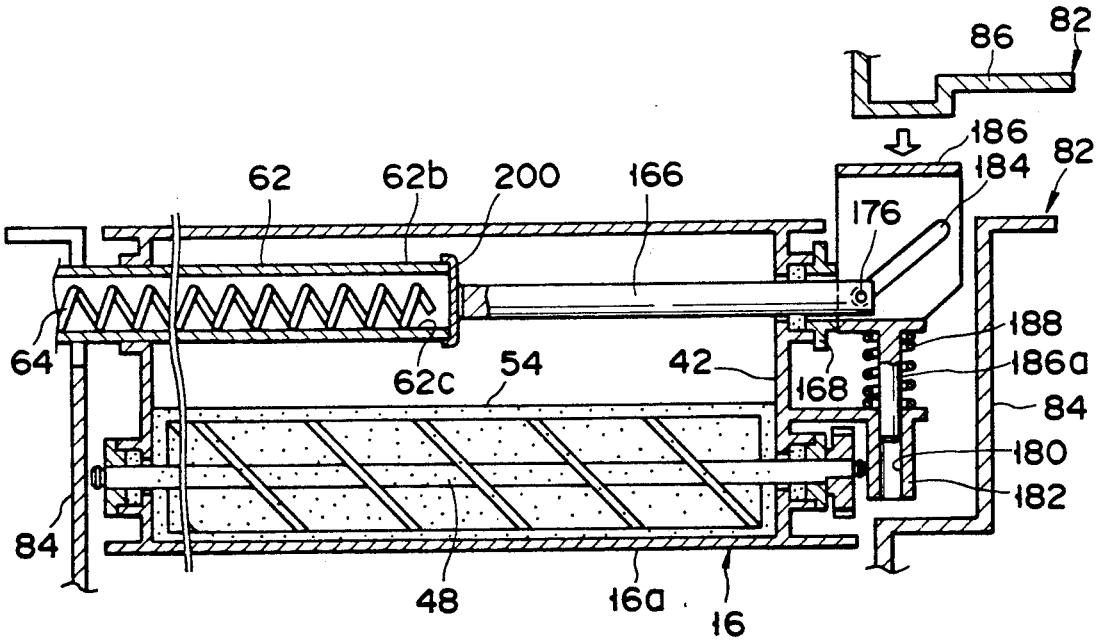
FIG. 33 is an enlarged schematical longitudinal sectional view of an end portion of developer conveying means of a variation of the developer restoring unit according the ninth embodiment shown in FIG. 28, which is located in a developing means, wherein a developer discharge opening at an opening end of a developing-means-side end portion of a communicating pipe of developer conveyor means is shielded by a thin seal.

In this variation, as shown in FIG. 33, seal sheet 200 of thin film is used instead of cylindrical shutter member 162 used in the ninth embodiment. In addition, end opening 62*c* at end portion 62*b* of pipe 62 is used as the toner discharge opening.

Seal sheet 200 covers toner discharge opening 62*c* of end portion 62*b* of pipe 62, and its rim portion is fixed to the outer circumferential surface of end portion 62*b* of pipe 62 by adhesive. The center portion of seal sheet 200 is fixed to the inner end of shutter driving shaft 166 by adhesive, and shutter driving shaft 166 is freely slidably by casing 16*a* of developing means 16.

Figure 34:
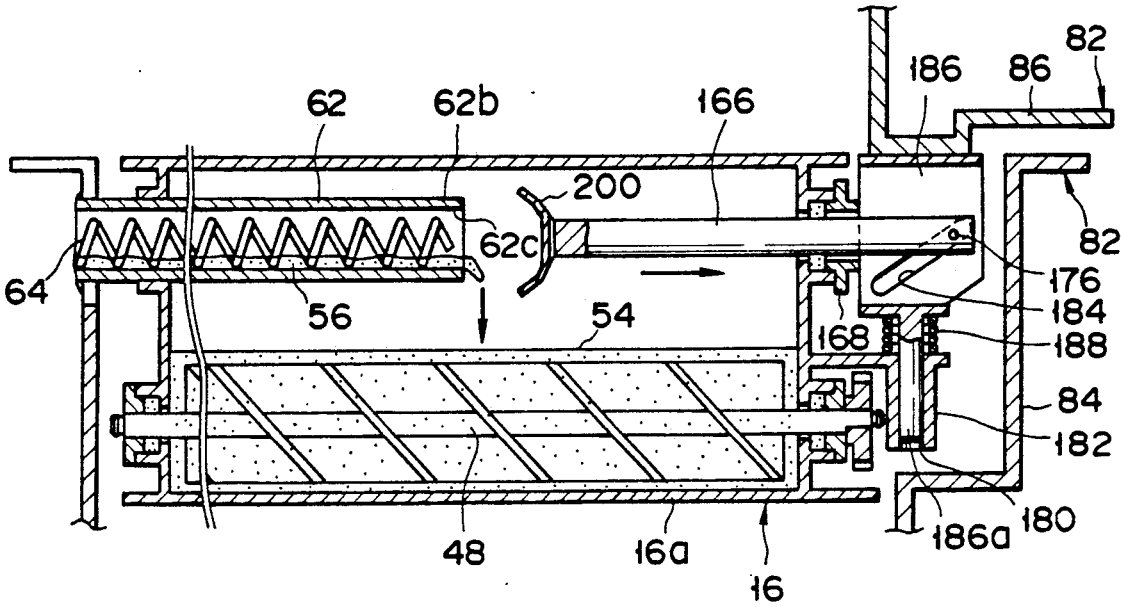
FIG. 34 is an enlarged schematical longitudinal sectional view similar to FIG. 33, but wherein the developer restoring unit in FIG. 33 is set in an image forming apparatus, so that a thin-seal-breaking member breaks the thin seal for the developer discharge opening of the communicating pipe.

When the image forming unit according to the variation and constructed as described above is set in lower body 84 of printer 82 (FIG. 10) and roof 86 is swung onto lower body 84, member 186 is pushed by a part of roof 86 and moved downward against the urging force of compression coil spring 188 as shown in FIG. 34, causing shutter driving shaft 166 to be moved away from end portion 62*b* of communicating pipe 62 in the axial direction of pipe 62. Seal sheet 200 is thus peeled off from end portion 62*b* of pipe 62 to open toner discharge opening 62*c*. Toner 56 conveyed from cleaner 20 (FIG. 10) to developing means 16 (FIG. 10) through pipe 62 by rotating toner conveying member 64 is allowed to fall into developing chamber 42 through toner discharge opening 62*c*.

Figure 35:
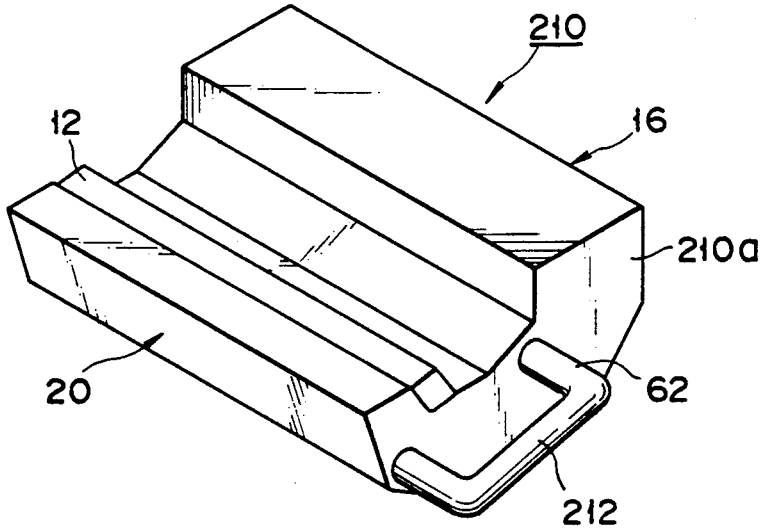
FIG. 35 is a schematical perspective view showing a developer restoring unit according to a tenth embodiment of the present invention, wherein a communicating pipe of developer conveying means is projected outside the unit between developing means and a cleaner to form a half ring shape, and serves as a handle for the unit.
Figure 36:
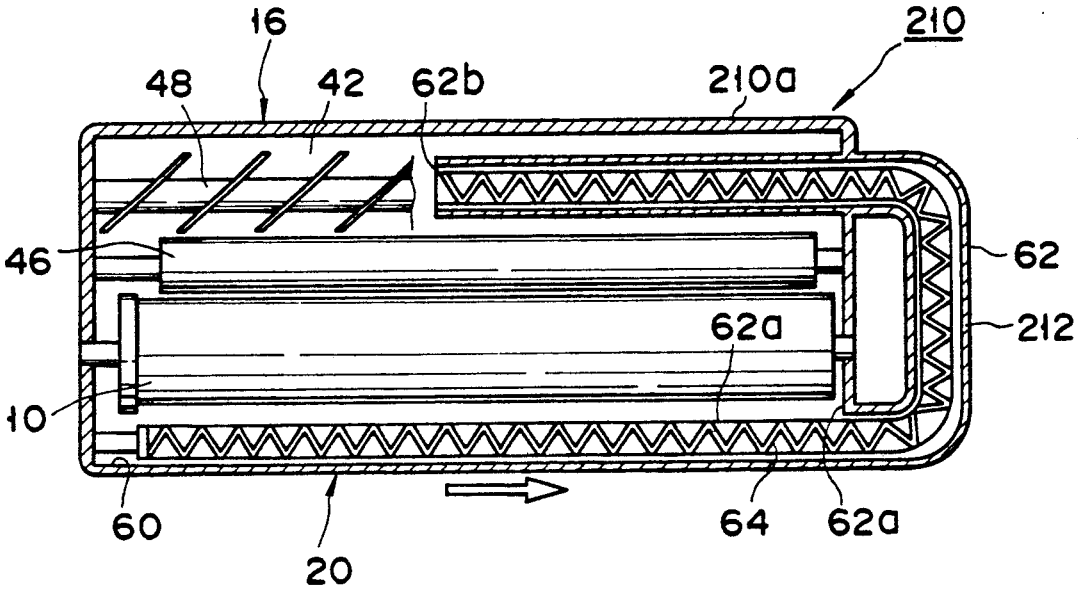
FIG. 36 is a schematical horizontal sectional view of the developer restoring unit shown in FIG. 35.

A tenth embodiment of the present invention will be described with reference to FIGS. 35 and 36.

The basic construction of image forming unit 210 according to the tenth embodiment of the present invention is the same as that of the image forming unit 40 of the first embodiment shown in FIG. 2. The same reference numerals in the tenth embodiment as those in the first embodiment denote the same components as in the first embodiment, and the description thereof will be omitted.

In this embodiment, communicating pipe 62 which extends between cleaning hopper 60 of cleaner 20 and developing chamber 42 in developing means 16 is projected outside the outer housing 210*a* of image forming unit 210 to form a half square ring. The outwardly projected portion of pipe 62 is integrally formed with outer housing 210*a*, and the thickness of the peripheral wall thereof is so enough to allow the outwardly projected portion to be used as handle 212 when image forming unit 210 is set in and detached from printer 9 in the horizontal direction.

When image forming unit 210 is set in printer 9 (FIG. 1), the outwardly projected portion (or handle 212) of communicating pipe 62 is located toward an operator.

Figure 37:
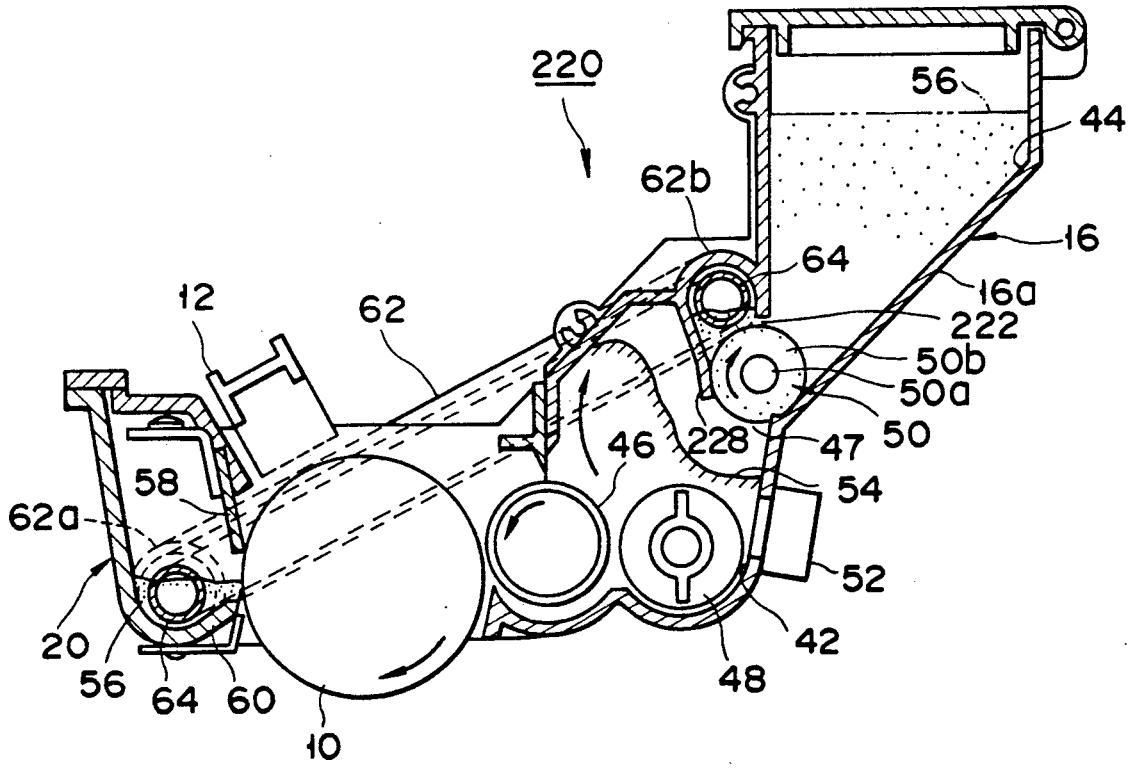
FIG. 37 is a schematical longitudinal sectional view showing a developer restoring unit according to an eleventh embodiment of the present invention.

An eleventh embodiment of the present invention will be described with reference to FIGS. 37 through 39. The fundamental construction of image forming unit 220 according to the eleventh embodiment is the same as that of image forming unit 40 of the first embodiment shown in FIG. 2. The same reference numerals in the eleventh embodiment as those in the first embodiment denote the same components as in the first embodiment, and the description thereof will be omitted.

In this embodiment, end portion 62*b* of communicating pipe 62 is not projected into the upper portion of developing chamber 42 but located above toner supply roller 50 between developing chamber 42 and toner supply chamber 44. End portion 62*b* of pipe 62 is made integral with casing 16*a* of developing means 16 to create a space independent of both developing chamber 42 and toner supply chamber 44. End portion 62*b* of pipe 62 extends substantially in parallel to toner supply roller 50, and slender toner discharge opening 222 is formed in the lower section of end portion 62*b* of pipe 62, which is opposed to toner supply roller 50 over a whole of end portion 62*b* in the axial direction thereof.

When image forming unit 220 according to the eleventh embodiment and constructed as described above is set in printer 9 and then printer starts printing process, toner, not transmitted from the photosensitive surface of drum 10 to a paper sheet and still left on drum 10, is scraped off from the photosensitive surface of drum 10 by cleaning blade 58 of cleaner 20 and collected on the bottom of hopper 60. Toner 56 in hopper 60 is conveyed to the developing-means-side end 62*b* of pipe 62 through pipe 62 by rotating toner conveying member 64 and then dropped onto toner supply roller 50 through toner discharge opening 222 at end portion 62*b* of pipe 62. Toner 56 dropped (or discharged) through toner discharge opening 222 enter into pores on porous elastic matter 50*b* which constructs the outer circumferential surface of toner supply roller 50. As shown in FIG. 39, the amount of toner 56 dropped on toner supply roller 50 through toner discharge opening 222 becomes smaller as it comes nearer to the terminal end of toner conveying member 64, and toner 56 conveyed from cleaner 20 into end portion 62*b* of pipe 62 enters successively from the entrance side of end portion 62*b* into pores on porous elastic matter 50*b* of toner supply roller 50.

Figure 38:
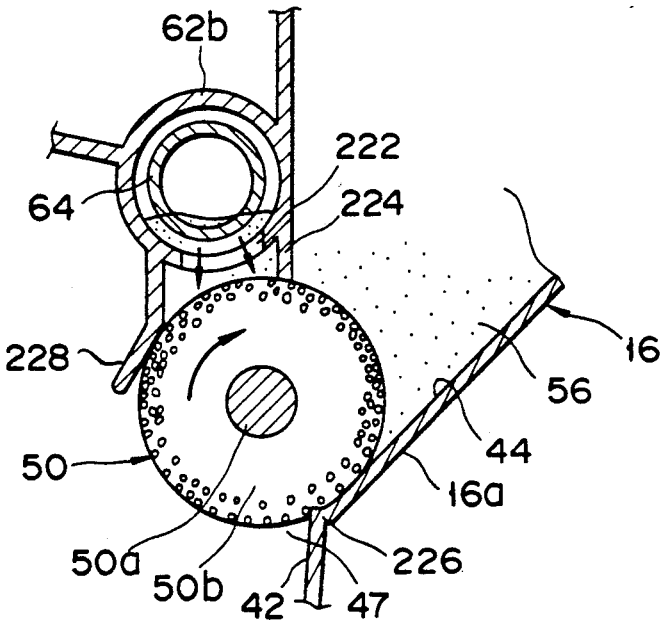
FIG. 38 is an enlarged schematical cross sectional view of a developer supply roller extending between a developing chamber and a developer supply chamber and covered with a porous elastic matter, and a developing-means-side end portion of a communicating pipe of developer conveying means extending above the roller, these roller and conveying means being employed by the developer restoring unit in FIG. 37.
Figure 39:
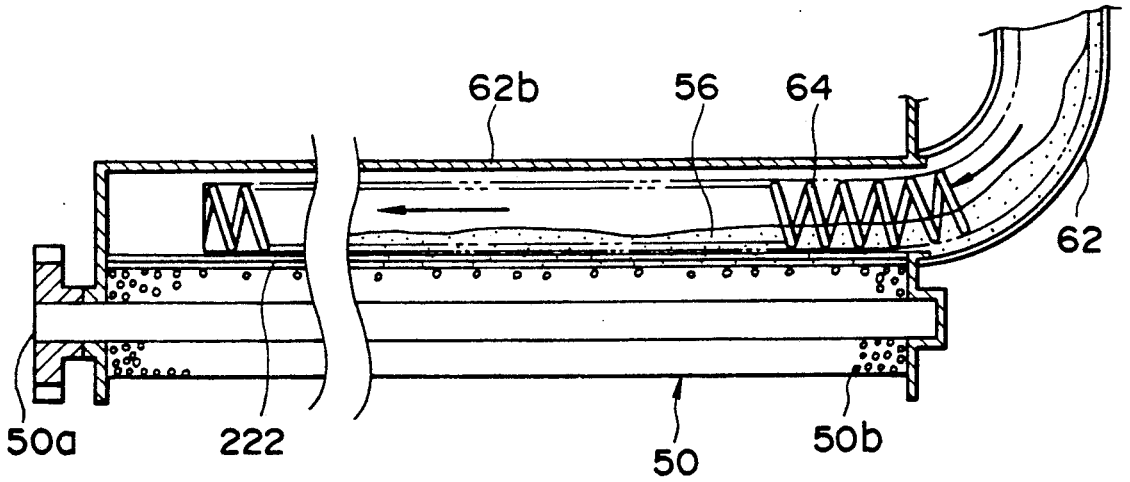
FIG. 39 is an enlarged schematical horizontal sectional view of the developer supply roller and the developing-means-side end of the communicating pipe.

When toner supply roller 50 is rotated in a clockwise direction, as shown by an arrow in FIG. 38, in responsive to toner-supply-signal generated from toner sensor 52, toner which does not enter into pores on porous elastic matter 50*b* of toner supply roller 50 is leveled by blade 224 located between toner discharge opening 222 and toner supply chamber 44, and only toner which has entered into pores reaches toner supply chamber 44. New toner in toner supply chamber 44 then enters into those pores on porous elastic matter 50*b* of toner supply roller 50, which are still left vacant. In other words, those pores on porous elastic matter 50*b* of toner supply roller 50 which are located near to the entrance side of end portion 62*b* of pipe 62 have been already filled with remnant toner 56 discharged from toner discharge opening 222, and therefore new toner enters into the other remaining pores which are located remote from the entrance of end portion 62*b* of pipe 62. Toner supply roller 50 which has been uniformly filled with toner in all pores on its porous elastic matter 50*b* as described above is forcibly abutted on projection 226 projected from casing 16*a* of developing means 16 into toner supply opening 47 between developing means 16 into toner supply opening 47 between developing chamber 42 and toner supply chamber 44, thereby causing toner in all pores to be scraped off into developing chamber 42 by projection 226. Toner supply roller 50 which has supplied toner into developing chamber 42 in this manner is rubbed by rubbing plate 228 between developing chamber 42 and toner discharge opening 222, and toner supply roller 50 is thus made ready for another supply of toner.

The above-described process is repeated, as long as toner-supply-signal is generated from toner sensor 52, to supply toner into developing chamber 42. All pores on porous elastic matter 50*b* of toner supply roller 50 are uniformly filled with toner. Therefore, the amount of toner supplied into developing chamber 42 by toner supply roller 50 is uniform in the longitudinal direction of roller 50.

What is claimed is:

1. A developer restoring unit, which is detachably set in an image forming apparatus including an image bearing member, means for forming latent images on the image bearing member, means for developing the latent images on the image bearing member, means for transferring the developed images on the image bearing member to recording means, a cleaner for removing developer still left on the image bearing member after the image transferring process, and means for conveying developer from the cleaner to the developer means, said developer restoring unit comprising a combination of at least the developing means, the cleaner, and the developer conveying means, the developer conveying means including a pipe in communication with both the cleaner and the developing means, a developer conveying member located in the pipe to convey developer from the cleaner to the developing means, and means for preventing developer from flowing backward from the developing means to the cleaner through said pipe before the developer restoring unit is first used, said developer-backflow-preventing means being located at a developing-means-side end portion of said pipe, and including a shield mechanism for opening a developer discharge opening formed at said developing-means-side end portion of said pipe when said developer restoring unit is first set in the image forming apparatus, said shield mechanism including a thin seal for shielding said developer discharge opening and breaking means for striking against a body portion of the image forming apparatus when the developer restoring unit is first set in the imaging forming apparatus and for breaking said thin seal duel to the striking of said breaking means against said body portion.

2. The developer restoring unit according to claim 1, wherein said pipe is projected outside said developer restoring unit between the cleaner and the developing means to form a half ring and serves as a handle for setting and detaching said unit in and from said image forming apparatus.

3. The developer restoring unit according to claim 1, wherein the developing means includes a developing chamber located adjacent to said image bearing member to develop a latent image on said image bearing member, a developer supply chamber located above said developing chamber and to which developer is supplied from outside, and a developer supply roll interposed between said developing chamber and said developer supply chamber, covered with porous elastic material on said outer circumference thereof, and rotated to supply developer from said developer supply chamber to said developing chamber through said porous elastic material, and wherein said developing-means-side end portion of said pipe is independent of said developing chamber and said developer supply chamber and located above said developer supply roll.

4. A developer restoring unit, which is detachably set in an image forming apparatus including an image bearing member, means for forming latent images on the image bearing member, means for developing the latent images on the image bearing member, means for transferring the developed images on the image bearing member to recording means, a cleaner for removing developer still left on the image bearing member after the image transferring process, and means for conveying developer from the cleaner to the developer means, said developer restoring unit comprising a combination of at least the developing means, the cleaner, and the developer conveying means, the developer conveying means including a pipe in communication with both the cleaner and the developing means, a developer conveying member located in the communicating pipe to convey developer from the cleaner to the developing means, and means for preventing developer from flowing backward from the developing means to the cleaner through said pipe before said developer restoring unit is first used, said developer-backflow-preventing means being located at a developing-means-side end portion of said pipe, and including a shield mechanism for opening a developer discharge opening formed at said developing-means-side end portion of said pipe when said developer restoring unit is first set in said image forming apparatus and upon first use thereof, wherein said image forming apparatus comprises a lower body and an upper body connected to said lower body to be swingable between open and closed positions, and wherein the developer restoring unit is set in said lower body after swinging up said upper body from said lower body toward said open position; and said shield mechanism includes a thin seal for shielding said developer discharge opening and breaking means for striking against said upper body of said image forming apparatus after said developer restoring unit is set in said lower body and when said upper body is swung downwardly onto said lower body to said closed position.

5. The developer restoring unit according to claim 4, wherein said pipe projects outside said developer restoring unit between the cleaner and the developing means to form a half ring and serves as a handle for setting and detaching said unit in and from said image forming apparatus.

6. The developer restoring unit according to claim 4, wherein the developing means includes a developing chamber located adjacent to said image bearing member to develop a latent image on said image bearing member, a developer supply chamber located above said developing chamber and to which developer is supplied from outside, and a developer supply roll interposed between said developing chamber and said developer supply chamber, covered with porous elastic material on an outer circumference thereof, and rotated to supply developer from said developer supply chamber to said developing chamber through said porous elastic material, and wherein said developing-means-side end portion of said pipe is independent of said developing chamber and said developer supply chamber and located above said developer supply roll.

7. A developer restoring unit, which is detachably set in an image forming apparatus including an image bearing member, means for forming latent images on the image bearing member, means for developing the latent images on the image bearing member, means for transferring the developed images on the image bearing member to recording means, a cleaner for removing developer still left on the image bearing member after the image transferring process, and means for conveying developer from the cleaner to the developer means, and said developer restoring unit comprising a combination of the developing means, the cleaner, and the developer conveying means, the developer conveying means including a pipe in communication with both the cleaner and the developing means, a developer conveying member located in the communicating pipe to convey developer from the cleaner to the developing means, and means for preventing developer from flowing backward from the developing means to the cleaner through said pipe before said developer restoring unit is first used, said developer-backflow-preventing means being located at a developing-means-side end portion of said pipe, and including a shield mechanism for opening a developer discharge opening formed at said developing-means-side end portion of said pipe when said developer restoring unit is first set in said image forming apparatus, and upon first use thereof, wherein said shield mechanism includes a shield member freely movably mounted on said developing-means-side open end portion of said pipe, and opening means for moving said shield member axially on said pipe to open said developer discharge opening, wherein said opening means comprises said developer conveying member, and said opening means causes said shield member to move on said developing-means-side end portion of said pipe in said axial direction to open said developer discharge opening.

8. The developer restoring unt according to claim 7, wherein said developer conveying member is a coil spring, said developer discharge opening is defined by an open end at the developing-means-side end portion of said pipe, said shield member is attached to said developer discharge opening against an urging force of said coil spring, and said shield member is released from said developer discharge opening by rotation of said coil spring and then separated from it by said urging force of said coil spring.

9. The developer restoring unit according to claim 7, wherein said developer conveying member is a spiral member.

10. The developer restoring unit according to claim 9, wherein the spiral member is a coil spring.

11. The developer restoring unit according to claim 7, wherein said pipe projects outside said eveloper restoring unit between the cleaner and the developing means to form a half ring and serves as a handle for setting and detaching said unit in and from said image forming apparatus.

12. The developer restoring unit according to claim 7, wherein the developing means includes a developing chamber located adjacent to said image bearing member to develop a latent image on said image bearing member, a developer supply chamber located above said developing chamber and to which developed is supplied from outside, and a developer supply roll interposed between said developing chamber and said developer suppy chamber, covered with porous elastic material on an outer circumference thereof, and rotated to supply developer from said developer supply chamber to said developoing chamber through said porous elastic material, and wherein said developing-means-side end portion of said pipe is independent of said developing chamber and said developer supply chamber and located above said developer supply roll.

13. A developer restoring unit, which is detachabley set in an image forming apparatus including an image bearing member, means for forming latent images on the image bearing member, means for developoing the latent images on the image bearing member, means for transferring the developed images on the image bearing member to recording means, a cleaner for removing developer still left on the image bearing member after the image transferrring process, and means for conveying developer from the cleaner to the developer means, said developer restoring unit comprising a combination of at least the developing means, the cleaner, and the developer conveying means, the developer conveying means including a pipe in communication with both the cleaner and the developing means, a developer conveying member located in the communicating pipe to convey developer from the cleaner to the developing means, and means for preventing develooper from flowing backward from the developing means to the cleaner through said pipe before said developer restoring unit is first used, said developer-backflow-preventing means being located at a developing-means-side end portion of said pipe, and including a shield mechanism for opening a developer discharge opening formed said the developing-side end portion of said pipe whch said developer restoring unit is first set in said image forming apparatus, and upon first use thereof, wherein said shield mechanism includes a shield member freely movably mounted on said developing-means-side open end portion of said pipe, and opening means for moving said shield member axially on said pipe to open said developer discharge opening, wherein said opening means projects outside said developing means and is connected to means for driving said developing-means, and said shield member is movable axially on said pipe to open said developer discharge opening when said developing-means driving means commences driving.

14. The developer restoring unit according to claim 13, wherein said shield member is connected to said opening means and movable axially by a predetermined distance to open said developer discharge opening, and the connection of said shield member to said opening means is then released and the axial movement thereof is stopped.

15. The developer restoring unit according to claim 14, and including means for detecting whether or not said shield member has been moved by said opening means over said predetermined distance so as to open said developer discharge opening .

16. The developer restoring unit according to claim 13, wherein said pipe projects outside said developer restoring unit between the cleaner and the developing means to form a half ring and serves as a handle for setting and detaching said unit in and from said image forming apparatus.

17. The developer restoring unit according to claim 13, wherein the developing means includes a developing chamber located adjacent to said image bearing member to develop a latent image on said image bearing member, a developer supply chamber located above said developing chamber and to which developer is supplied from outside, and a developer supply roll interposed between said developing chamber and said developer supply chamber, covered with porous elastic material in an outer curcumference thereof, and rotated to supply developer from said developer supply chamber to said developing chamber through said porous elastic material, and wherein said developing-means-side end portion of said pipe is independent of said developing chamber and said developer supply chamber and located above said developer supply roll.

18. A developer restoring unit, which is detachably set in an image forming apparatus including an image bearing member, means for forming latent images on the image bearing member, means for developing the latent images on the image bearing member, means for transferring the developed images on the image bearing member to recording means, a cleaner for removing developer still left on the image bearing member after the image transferring process, and means for conveying developer from the cleaner to the developer means, and said developer restoring unit comprising a combination of at least the developing means, the cleaner, and the developer conveying means, the developer conveying means including a pipe in communication with both the cleaner and the developing means, a developer conveying member located in the communicating pipe to convey developer from the cleaner to the developing means, and means for preventing developer from flowing backward from the developing means to the cleaner through aid pipe before said developer restoring unit is first used, said developer-backflow-preventing means being located at a developing-means-side end portion of said pipe, and including a shield machinism for opening a developer discharge opening formed at said developing-means-side end portion of said pipe when said developer restoring unit is first set in said image forming apparatus, and upon first use thereof, wherein said shield mechanism includes a shield member freely movably mounted on said developing-means-side open end portion of said pipe, and opening means for moving said shield member axially on said pipe to open said discharge opening, wherein said discharge opening is formed in a circumferential wall of said developing-means-side end portion of said pipe, and wherein said shield member has a second developer discharge opening in its circumferential wall, said opening means effective to rotate said shield member on said developing-means-side end portion of said pipe in a curcumferential direction so that said dischrage opening of said shield member will align with said discharge opening in said developing-means-side end portions of said pipe, and wherein said opening means comprises said developer conveying member, and said shield member is rotated on said pipe in the circumferential direction upon rotation of said developer conveying member.

19. The developer restoring unit according to claim 18, wherein said pipe projects outside said developer restoring unit between the cleaner and the developing means to form a half ring and serves as a handle for setting and detaching said unit in and from said image forming apparatus.

20. The developer restoring unit according to claim 18, wherein the developing means includes a developing chamber located adjacent to said image bearing member to develop a latent image on said image bearing member, a developer supply chamber located above said developing chamber and to which developer is supplied from outside, and a developer supply roll interposed between said developing chamber and said developer supply chamber, covered with porous elastic material on an outer circumference thereof, and rotated to supply developer from said developer supply chamber to said developing chamber through said porous elastic material, and wherein said developing-means-side end portion of said pipe is independent of said developing chamber and said developer supply chamber and located above said developer supply roll.

21. A developer restoring unit, which is detachably set in an image forming apparatus including an image bearing member, means for forming latent images on the image bearing member, means for developing the latent images on the image bearing member, means for transferring the developed images on the image bearing member to recording means, a cleaner for removing developer still left on the imagre bearing member after the image transferring process, and means for conveying developer from the cleaner to the developer means, said developer restoring unit comprising a combination of at least the developing means, the cleaner, and the developer conveying means, the developer conveying means including a pipe in communication with both the cleaner and the developing means, a developer conveying member located in the communicating pipe to convey developer from the cleaner to the developing means, and means for preventing developer from flowing backward from the developing means to the cleaner through said pipe before said developer restoring unit is first used, said developer-backflow-preventing means being located at a developing-means-side end portion of said pipe, and including a shield mechanism for opening a developer discharge opening formed at said developing-means-side end portion of said pipe when said developer restoring unit is first set in said image forming apparatus, and upon first use thereof, wherein said sheild mechanism includes a shield member freely movably mounted on said developing-means-side open end portion of said pipe, and opening means for moving said shield member axially on said pipe, wherein said developer discharge opening is formed in a circumferential wall of said developing-means-side end portion of said pipe, and wherein said shield member has a second developer discharge opening in its circumferential wall, said opening means effective to rotate said shield member on said developing-means-side end portion of said pipe in a circumferential direction so that said second discharge opening of said shield member will align with said discharge opening in said developing-means-side end portion of said pipe, and wherein said opening means includes means for driving said developing-means, said shield member projecting outside said developing means and connected to said driving means so that said shield is rotated on said developing-means-side open end portion of said pipe in a circumferential direction when said driving means commence driving.

22. The developer restoring unit according to claim 21, wherein, said pipe projects outside said developer restoring unit between the cleaner and the developing means to form a half ring and serves as a handle for setting and detaching said unit in and from said image apparatus.

23. The developer restoring unit according to claim 21, wherein the developing means includes a developing chamber located adjacent to said image bearing member to develop a latent image on said image bearing, members, a developer supply chamber located above said developing chamber and to which developer is supplied from outside, and a developer supply roll interposed between said developing chamber and said developer supply chamber, covered with porous elastic mateiral on an outer circumference thereof, and rotated to supply developer from said developer supply chamber to said developing chamber through said porous elastic material, and wherein said developing-means-side end portion of said pipe is independent of said developing chamber and said developer supply chamber and located above said developer supply roll.

24. A developer restoring unit, which is detachably set in an image forming apparatus including an image bearing member, means for forming latent images on the image bearing member, means for developing the latent images on the imge bearing member, means for transferring the developed images on the image bearing member to recording means, a cleanor for removing developer still left on the image bearing member after the image transferring process, and means for conveying developer from the cleaner to the developer means, said developer restoring unit comprising a combination of at least the developing means, the cleaner, and the developer conveying means, the developer conveying means including a pipe in communication with both the cleaner and the developing means, a developer conveying member located in communicating pipe to convey developer from the cleaner to the developing means, and means for preventing developer from flowing backward from the developing means to the cleaner through said pipe before said developer restoring unit is first used, said developer-backflow-preventing means being located at a developing-means-side end portion of the communicating pipe, and including a shield mechanism for opening a developer discharge opening formed at said developing-means-side ene portion of said pipe when said developer restoring unit is first set in said image forming apparatus, and upon first use thereof, wherein said discharge opening is formed in a circumferential wall of said developing-means-side end portion of said pipe, and said shield mechanism includes a magnet arranged around said discharge opening and a developer-pusing-out member driven by said developer conveying member to push out developer from said developing-meansd-side end portion of said pipe into said developing means through said discharge opening.

25. The developer restoring unit according to claim 24, wherein said developer-pushing-out member is a sheet member fixed to a terminal ene of said developer conveying member.

26. The developer restoring unit according to claim 24, wherein said pipe projects outside said developer restoring unit between the cleaner and the developing means to form a half ring and serves as a handle for setting and detaching said unit in and from said image forming apparatus.

27. The developer restoring unit according to claim 24, wherein the developing means includes a developing chamber located adjacent to said image bearing member to developd a latent image on said image bearing member, a developer supply chamber located above said developing chamber and to which developer is supplied from outside, and a developer supply roll interposed between said developing chamber and said developer supply chamber, covered with porous elastic material on an outer circumference thereof, and rotated to supply developer from said developer supply chamber to said developing chamber through said porous elastic material, and wherein said developing-means-side end portion of said pipe is independent of said developing chamber and said developer supply chamber and located above said developer supply roll.

28. A developer restoring unit, which is detachably set in an image forming apparatus including an image bearing member, means for forming latent images on the image bearing member, means for developing the latent images on the image bearing member, means for transferring the developed images on the image bearing member to recording means, a cleaner for removing developer still left on the image bearing member after the image transferring process, and means for conveying developer from the cleaner to the developer means, said developer restoring unit comprising a combination of at least the developing means, the cleaner, and the developer conveying means, the developer conveying means including a pipe in communication with both the cleaner and the developing means, a developer conveying member located in the communicating pipe to convey developer from the cleaner to the deveolping means, and means for preventing developer from flowing backward from the developing means to the cleaner though said pipe before the developer restoring unit is first used, said developer-backflow-preventing means being located at a developing-means-side end portion of said pipe, and including a sheild mechanism for opening a developer discharge opening formed at said developing-means-side end portion of said pipe when said developer restoring unit is first set in said image forming apparatus, and upon first use thereof, wherein an open end of said developing-means-side end portion of said pipe serves as said discharge opening, and said shield mechanism includes a thin seal for shielding said discharge opening and breaking means driven to break said thin seal when said developer restoring unit is first set in said image forming apparatus and upon first use thereof.

29. The developer restoring unit according to claim 28, wherein said breaking means is mounted on a terminal end portion of said developer conveying member, and said breaking means in driven by action of said developer conveying member to break said thin seal.

30. The developer restoring unit according to claim 28, wherein said breaking means projects outside said developing means and is connected to said developingu-means driving means, and said developing-means driving means, and said breaking means is movable in an axial direction of said pipe to break said thin seal.

31. The developer restoring unit according to claim 28, wherein said pipe projects outside said developer restoring unit between the cleaner and the developing means to form a half ring and serves as a handle for setting and detaching said unit in and from said image forming apparatus.

32. The developer restoring unit according to claim 28, wherein the developing means includes a developing chamber located adjacent to said image bearing member to develop a latent image on said image bearing member, a developer supply chamber located above said developing chamber and to which developer is suppled from outside, and a developer supply roll interposed between said developing chamber and said developer supply chamber, covered with porous elastic material on an outer circumference thereof, and rotated to suppy developer from said developer supply chamber to said developing chamber through said porous elastic material, and wherein said developing-means-side end portion of said pipe is independent of said developing chamber and said developer supply chamber and located above said developer supply roll.

* * * * *

UNITED STATES PATENT AND TRADEMARK OFFICE

CERTIFICATE OF CORRECTION

PATENT NO. : 5,128,724

DATED : July 7, 1992

INVENTOR(S) : HAYASHI ET AL.

It is certified that error appears in the above-indentified patent and that said Letters Patent is hereby corrected as shown below:

Title page under numeral "[30] Foreign Application Priority Data", insert after the last document number "1-26778" --[U]--.

Signed and Sealed this

Seventeenth Day of May, 1994

Bruce Lehman

*Attest:*

BRUCE LEHMAN

*Attesting Officer*

*Commissioner of Patents and Trademarks*